US007905432B2

(12) United States Patent
Nomura et al.

(10) Patent No.: US 7,905,432 B2
(45) Date of Patent: Mar. 15, 2011

(54) CASTING NOZZLE

(75) Inventors: Osamu Nomura, Tokyo (JP); Masamichi Takai, Tokyo (JP); Masaru Kurisaki, Tokyo (JP); Hidetaka Ogino, Tokyo (JP); Toshio Horiuchi, Tokyo (JP); Shinsuke Inoue, Tokyo (JP)

(73) Assignee: Shinagawa Refractories Co., Ltd., Tokyo (JP)

( * ) Notice: Subject to any disclaimer, the term of this patent is extended or adjusted under 35 U.S.C. 154(b) by 1521 days.

(21) Appl. No.: 10/522,680

(22) PCT Filed: Jul. 30, 2003

(86) PCT No.: PCT/JP03/09655

§ 371 (c)(1),
(2), (4) Date: Oct. 18, 2005

(87) PCT Pub. No.: WO2004/011175

PCT Pub. Date: Feb. 5, 2004

(65) Prior Publication Data

US 2006/0124776 A1 Jun. 15, 2006

(30) Foreign Application Priority Data

| | | |
|---|---|---|
| Jul. 31, 2002 | (JP) | 2002-222704 |
| Nov. 27, 2002 | (JP) | 2002-343684 |
| Feb. 25, 2003 | (JP) | 2003-047889 |
| Mar. 20, 2003 | (JP) | 2003-077905 |

(51) Int. Cl.
*B05B 1/00* (2006.01)
*B05B 1/34* (2006.01)

(52) U.S. Cl. ..... 239/591; 239/589; 239/101; 239/483; 222/591; 222/606; 222/607; 164/437; 164/47

(58) Field of Classification Search ..... 239/101, 239/142, 461, 483, 489, 589, 593, 595; 222/591, 222/606, 607; 427/225, 349; 164/47
See application file for complete search history.

(56) References Cited

U.S. PATENT DOCUMENTS 4,730,754 A 3/1988 Buhr et al.
(Continued)

FOREIGN PATENT DOCUMENTS

JP 57-130745 A 8/1982
(Continued)

OTHER PUBLICATIONS

International Search Report for PCT/JP 03/09655 dated Nov. 11, 2003.

*Primary Examiner* — Len Tran
*Assistant Examiner* — James S Hogan
(74) *Attorney, Agent, or Firm* — Sughrue Mion, PLLC

(57) ABSTRACT

An object of the invention is to provide a casting nozzle in which attachment and deposition of alumina or the like can be prevented while a drift of molten steel can be prevented.
The casting nozzle according to the invention is characterized in that the casting nozzle has a molten steel flow hole portion in which "a plurality of independent protrusion portions and/or concave portions" are disposed so that each of the protrusion portions and/or concave portions has a size satisfying the expression (1): H≧2 mm and the expression (2): L>2×H mm [in which "H" shows the maximum height of the protrusion portion or the maximum depth of the concave portion, and "L" shows the maximum length of a base portion of the protrusion portion or concave portion].

20 Claims, 15 Drawing Sheets

U.S. PATENT DOCUMENTS

| | | | | | |
|---|---|---|---|---|---|
| 4,746,038 | A | * | 5/1988 | Ohwada et al. | 222/603 |
| 4,779,775 | A | * | 10/1988 | Kimura et al. | 222/603 |
| 4,977,950 | A | * | 12/1990 | Muench | 164/429 |
| 5,083,687 | A | * | 1/1992 | Saito et al. | 222/591 |
| 5,328,064 | A | * | 7/1994 | Nanba et al. | 222/607 |
| 5,885,520 | A | * | 3/1999 | Hoover | 266/45 |
| 6,425,505 | B1 | | 7/2002 | Heaslip et al. | |
| 6,675,996 | B1 | * | 1/2004 | Miyamoto et al. | 222/594 |
| 6,932,250 | B2 | * | 8/2005 | Bederka | 222/606 |

FOREIGN PATENT DOCUMENTS

| | | | | |
|---|---|---|---|---|
| JP | 59-22913 | Y2 | | 7/1984 |
| JP | 61-72361 | U | | 5/1986 |
| JP | 62-89566 | A | | 4/1987 |
| JP | 62-207568 | A | | 9/1987 |
| JP | 63-40670 | A | | 2/1988 |
| JP | 2-41747 | A | | 2/1990 |
| JP | 400635 | U | | 1/1992 |
| JP | 6-269913 | A | | 9/1994 |
| JP | 7-23091 | Y2 | | 5/1995 |
| JP | 8294757 | | | 11/1996 |
| JP | 9-285852 | A | | 11/1997 |
| JP | 11-47896 | A | | 2/1999 |
| JP | 3050101 | B2 | | 3/2000 |
| JP | 2000-237852 | A | | 9/2000 |
| JP | 2000-237854 | A | | 9/2000 |
| JP | 2001-105106 | A | | 4/2001 |
| JP | 2001105106 | A | * | 4/2001 |
| JP | 2007167869 | A | * | 7/2007 |

* cited by examiner

FIG. 2

| | | EXAMPLE | |
|---|---|---|---|
| | | 1 | 2 |
| | DIAMETER D (mm) OF INNER HOLE PORTION | 80 | 90 |
| PROTRUSIONS | APPROXIMATE SHAPE | ELLIPTIC | SPHERICAL |
| | | 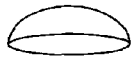 – | 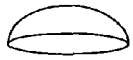 – |
| | MAXIMUM HEIGHT H (mm) | 8 | 10 |
| | MAXIMUM LENGTH L (mm) OF BASE PORTION | 32 | 27 |
| | NUMBER OF DISPOSED PROTRUSIONS | 54 | 70 |
| L/H | | 4.0 | 2.7 |
| πD/L | | 7.9 | 10.5 |
| SURFACE AREA INCREASING RATE (%) | | 116 | 114 |
| WATER MODEL | DEGREE OF DRIFT | NO | NO |
| | MINUS FLOW (PRESENCE OR ABSENCE OF SUCTION FLOW) | ABSENT | ABSENT |
| ACTUAL MACHINE | STRENGTH OF PROTRUSIONS | OK | OK |
| | DEPOSITION (mm) OF ALUMINA ON INNER PIPE | 1 | 0 |
| TOTAL EVALUATION | | ◎ | ◎ |

| EXAMPLE | | | | | |
|---|---|---|---|---|---|
| 3 | 4 | 5 | 6 | 7 | 8 |
| 80 | 80 | 80 | 60 | 80 | 80 |
| SPHERICAL | SPHERICAL | CONICAL | TRAPEZOID | TRAPEZOID | TRAPEZOID |
| 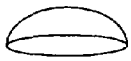 – | 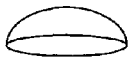 – | 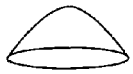 | 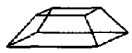 | 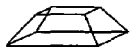 | 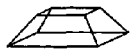 |
| 2 | 5 | 10 | 5 | 15 | 10 |
| 10 | 15 | 22 | 58 | 31 | 21 |
| 60 | 50 | 90 | 30 | 230 | 250 |
| 5.0 | 3.0 | 2.2 | 11.6 | 2.1 | 2.1 |
| 25.1 | 16.7 | 11.4 | 3.2 | 8.1 | 12.0 |
| 102 | 106 | 115 | 119 | 345 | 240 |
| NO | NO | NO | NO | NO | NO |
| ABSENT | ABSENT | ABSENT | ABSENT | ABSENT | ABSENT |
| OK | OK | OK | OK | OK | OK |
| 3 | 1 | 1 | 0 | 3 | 0 |
| ○ | ◎ | ◎ | ◎ | ○ | ◎ |

FIG. 3

| | | COMPARATIVE EXAMPLE | |
|---|---|---|---|
| | | 1 | 2 |
| | DIAMETER D (mm) OF INNER HOLE PORTION | 80 | 90 |
| PROTRUSIONS | APPROXIMATE SHAPE | STEPPED | STRAIGHT |
| | | | NONE |
| | MAXIMUM HEIGHT H (mm) | 5 | – |
| | MAXIMUM LENGTH L (mm) OF BASE PORTION | (CIRCUMFERENTIAL LENGTH: 251) | – |
| | NUMBER OF DISPOSED PROTRUSIONS | 1 | 0 |
| L/H | | (50.2) | – |
| πD/L | | 1.0 | – |
| SURFACE AREA INCREASING RATE (%) | | 97 | 100 |
| WATER MODEL | DEGREE OF DRIFT | MIDDLE | LARGE |
| | MINUS FLOW (PRESENCE OR ABSENCE OF SUCTION FLOW) | PRESENT | PRESENT |
| ACTUAL MACHINE | STRENGTH OF PROTRUSIONS | OK | – |
| | DEPOSITION (mm) OF ALUMINA ON INNER PIPE | 8 | 12 |
| TOTAL EVALUATION | | × | × |

| COMPARATIVE EXAMPLE | | | | | |
|---|---|---|---|---|---|
| 3 | 4 | 5 | 6 | 7 | 8 |
| 80 | 80 | 80 | 60 | 80 | 80 |
| SPHERICA 1 | CONICAL | SPHERICA 1 | SPHERICA 1 | ELLIPTIC | TRAPEZOI d |
| | | – | – | – | |
| 10 | 5 | 1 | 5 | 2 | 12 |
| 8 | 3 | 10 | 10 | 3 | 24 |
| 50 | 50 | 50 | 50 | 80 | 350 |
| 0.8 | 0.6 | 10.0 | 2.0 | 1.5 | 2.0 |
| 31.4 | 83.7 | 25.1 | 25.1 | 83.7 | 10.5 |
| 115 | 103 | 102 | 104 | 101 | 364 |
| NO | NO | LARGE | SMALL | MIDDLE | SMALL |
| ABSENT | ABSENT | PRESENT | ABSENT | PRESENT | PRESENT |
| NG | NG | OK | NG | NG | OK |
| 6 | 6 | 10 | 5 | 6 | 7 |
| × | × | × | × | × | × |

5mm
51 PROPELLER FLOWMETER
50
IMMERSION NOZZLE
X
DISCHARGE HOLE SURFACE
50

10mm
CENTER
10mm
: 5mm FROM UPPER END
: CENTER
: 5mm FROM LOWER END
1
2
3
4
5
6
7
8
9

FIG. 7(A)

[IMMERSION NOZZLE ACCORDING TO COMPARATIVE EXAMPLE 1]

[THROUGHPUT: EQUIVALENT TO 3 STEEL T/MIN]

| | LEFT | | | RIGHT | | |
|---|---|---|---|---|---|---|
| | REAR | CENTER | FRONT | FRONT | CENTER | REAR |
| UPPER | 39 | 3 | −1 | 8 | 49 | 51 |
| CENTER | 13 | 16 | 8 | 41 | 11 | 3 |
| LOWER | −2 | 36 | 38 | 58 | −9 | 9 |

[THROUGHPUT: EQUIVALENT TO 5 STEEL T/MIN]

| | LEFT | | | RIGHT | | |
|---|---|---|---|---|---|---|
| | REAR | CENTER | FRONT | FRONT | CENTER | REAR |
| UPPER | 88 | 22 | −6 | 20 | 83 | 103 |
| CENTER | 14 | 31 | 12 | 70 | 22 | 7 |
| LOWER | −18 | 60 | 68 | 96 | −10 | −1 |

[THROUGHPUT: EQUIVALENT TO 7 STEEL T/MIN]

| | LEFT | | | RIGHT | | |
|---|---|---|---|---|---|---|
| | REAR | CENTER | FRONT | FRONT | CENTER | REAR |
| UPPER | 102 | 40 | 0 | 22 | 97 | 106 |
| CENTER | 27 | 27 | 32 | 78 | 38 | 21 |
| LOWER | 6 | 95 | 75 | 98 | 19 | 10 |

| FLOW RATE | |
|---|---|
| 0> | |
| 0-50 | |
| 50-100 | |
| 100< | |

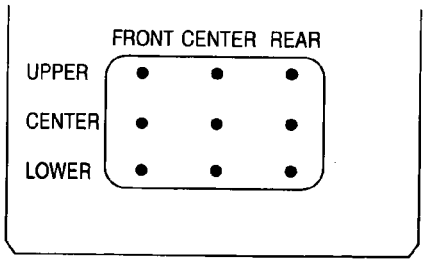

FIG. 7(B)

[IMMERSION NOZZLE ACCORDING TO EXAMPLE 1]

| | LEFT | | | RIGHT | | |
|---|---|---|---|---|---|---|
| | REAR | CENTER | FRONT | FRONT | CENTER | REAR |
| UPPER | 3 | 13 | 18 | 23 | 20 | 12 |
| CENTER | 18 | 16 | 18 | 25 | 26 | 27 |
| LOWER | 41 | 43 | 2 | 25 | 36 | 22 |

| | LEFT | | | RIGHT | | |
|---|---|---|---|---|---|---|
| | REAR | CENTER | FRONT | FRONT | CENTER | REAR |
| UPPER | 41 | 27 | 16 | 24 | 39 | 55 |
| CENTER | 11 | 21 | 36 | 39 | 32 | 22 |
| LOWER | 15 | 77 | 41 | 62 | 52 | 12 |

| | LEFT | | | RIGHT | | |
|---|---|---|---|---|---|---|
| | REAR | CENTER | FRONT | FRONT | CENTER | REAR |
| UPPER | 122 | 59 | 26 | 37 | 62 | 98 |
| CENTER | 32 | 32 | 38 | 63 | 60 | 42 |
| LOWER | 55 | 66 | 62 | 98 | 43 | 29 |

FIG. 11

| | EXAMPLE | | | | |
|---|---|---|---|---|---|
| | 12 | 13 | 14 | 15 | 16 |
| SECTIONAL SHAPE OF PROTRUSION PORTION | 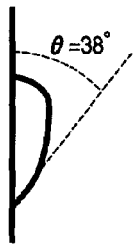  | 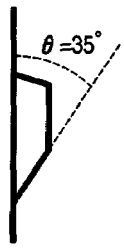  | 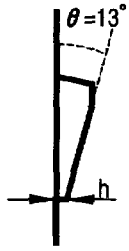  | 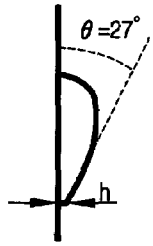  | 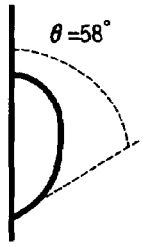  |
| PRESENCE OR ABSENCE OF STAGNATION JUST UNDER PROTRUSION | ABSENT | ABSENT | ABSENT | ABSENT | ABSENT |
| STRAIGHTENING EFFECT | GOOD | GOOD | GOOD | GOOD | GOOD |

| | COMPARATIVE EXAMPLE | | | | |
|---|---|---|---|---|---|
| | 14 | 15 | 16 | 17 | 18 |
| SECTIONAL SHAPE OF PROTRUSION PORTION | 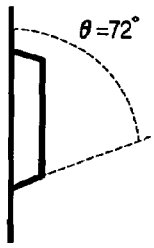  | 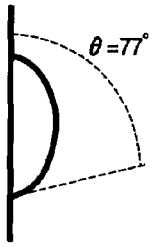  | 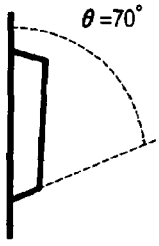  | 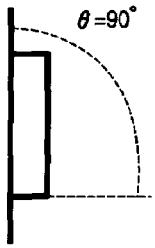  | 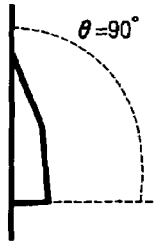  |
| PRESENCE OR ABSENCE OF STAGNATION JUST UNDER PROTRUSION | PRESENT | PRESENT | PRESENT | PRESENT | PRESENT |
| STRAIGHTENING EFFECT | BAD | BAD | BAD | BAD | BAD |

「H=7」
「L=22」

「H=11」
「L=22」

「H=18」
「L=22」

CASTING NOZZLE

TECHNICAL FIELD

The present invention relates to a casting nozzle mainly concerning a nozzle for continuously casting steel, such as an immersion nozzle, a long nozzle, etc.

BACKGROUND ART

An immersion nozzle, a long nozzle, a tundish nozzle, a semi-immersion nozzle, etc. are known as nozzles for continuously casting steel.

An "immersion nozzle" will be described as an example of the nozzle for continuously casting steel. The purpose of use of the immersion nozzle is to seal a tundish and a mold from each other to thereby prevent re-oxidation of molten steel and to control a flow of molten steel out of a discharge hole of the immersion nozzle and uniformly supply molten steel into the mold to attain operating stability and improvement in cast piece quality.

As a method for controlling the flow rate of molten steel for supplying the molten steel into the mold through the immersion nozzle, there is known a stopper method or a slide plate method. Particularly, in the slide plate method, a set of two or three hole-including plates are used so that one of the hole-including plates is slid to adjust the flow rate on the basis of the aperture of the hole. Accordingly, if the aperture is small, a drift is apt to occur in the immersion nozzle. If such a drift occurs in the immersion nozzle, the flow rate out of each discharge hole becomes so ununiform that a drift occurs in the mold to deteriorate cast piece quality.

Prevention of the drift in the immersion nozzle is important in order to improve cast piece quality. As a technique for preventing the drift in the immersion nozzle, there is known a method of improving the shape of an inner hole portion of the nozzle. For example, "provision of ring-like protrusions" has been proposed as described in an "immersion nozzle (Patent Document 1) having a molten steel flow hole provided with a plurality of step portions", an "immersion nozzle (Patent Document 2) having a molten metal introduction portion provided with a throttle portion to use a region of from the throttle portion to a discharge hole as a flow rate relaxing portion", and a "continuous casting immersion nozzle (Patent Document 3) having four or more wavy folds each shaped like a circular arc and provided continuously in the flowing direction of molten metal in an inner surface of a nozzle hole so that the distance between adjacent peaks of the folds is from 4 to 25 cm and the depth between a peak and a corresponding trough is from 0.3 to 2 cm". "Provision of helical protrusions" has been also proposed as described in a "casting nozzle (Patent Document 4) having an inner wall provided with spiral grooves or protrusions", an "immersion nozzle (Patent Document 5) having an inner wall preferably provided with double-helical or triple-helical protrusions", and so on. There have been further proposed a "nozzle (Patent Document 6) having semi-spherical concave-convex portions formed in a surface of a molten metal flow passage", a "casting nozzle (Patent Document 7) having convex or concave portions in an inner surface of a nozzle hole so that the convex or concave portions are continuous in a direction perpendicular to the flowing detection of molten steel", and an "immersion pipe (Patent Document 8) having a throttle ring disposed in a free transverse section of the immersion pipe to narrow the free transverse section of the immersion pipe and form a longitudinal section of the throttle ring to generate a laminar flow of molten metal in an outflow port, the throttle ring being disposed in the immersion pipe".

On the other hand, when Al killed steel or the like is cast, a mainly alumina-containing non-metal inclusion (hereinafter referred to as "alumina" simply in this description) is generally attached and deposited on a molten steel flow hole portion surface (inner pipe surface) of the immersion nozzle. If the amount of alumina deposited on the inner pipe surface of the immersion nozzle becomes large, the operation becomes unstable because the increase in the amount of alumina causes narrowing of the nozzle inner hole portion, reduction in casting speed, drifting of a discharge flow, blocking of the nozzle inner hole, etc. Moreover, if part of the deposited alumina is dropped out by a flow of molten steel, penetrated into the mold and caught in a solidification shell, cast piece quality is lowered because of a large-size inclusion defect. As described above, "deposition of alumina" on the inner pipe surface of the immersion nozzle exerts a bad influence on both operation and cast piece quality as well as reduction in the lifetime of the nozzle. This phenomenon also occurs in other nozzles such as a long nozzle, a tundish nozzle, etc.

As general means for preventing alumina from being deposited in the casting nozzle, there is known a method of spraying inert gas. Generally, this method is a method of spraying inert gas from an insert nozzle or upper plate of a slide gate or from a stopper fitting portion of an insertion type immersion nozzle. When the cleanliness factor of molten steel is low, a method of spraying inert gas directly from the immersion nozzle is also carried out.

A material (alumina-deposition-free material) applied to the nozzle has been proposed in order to prevent alumina from being deposed on the casting nozzle. For example, provision of a boron nitride (BN)-containing material (Patent Document 9), a BN—C refractory material (the aforementioned Patent Document 1), or the like, in the inner hole portion of the immersion nozzle has been proposed. Provision of an $Al_2O_3$—$SiO_2$—C material, a CaO—$ZrO_2$—C material, a carbonless refractory material or the like has been further proposed.

A large number of proposals have been further made from the aspect of the shape of the inner hole portion of the casting nozzle. For example, besides the aforementioned Patent Documents 1 to 8, there have been proposed a "molten metal injection nozzle (Patent Document 10) having a plurality of grooves formed along the lengthwise direction of its inner wall in a region of the inner wall including a portion of collision with molten metal", a "molten metal induction pipe (Patent Document 11) having an inner wall provided with at least one helical step and having a portion in which the sectional area of a molten metal flow path is reduced gradually in a region ranging from the inlet side to the outlet side", a "continuous casting immersion nozzle (Patent Document 12) having a slit-like discharge hole in a bottom portion of the continuous casting immersion nozzle, and orifices in the inside of the nozzle, having a structure in which the shape of a planar section surrounded by each orifice is elliptical or rectangular or such a shape that each rectangular short side replaced by a circular arc to narrow a flow of molten metal flowing in the immersion nozzle, and formed so that the direction of each long side of the planar section surrounded by the orifice is perpendicular to the direction of each long side of a planar section of the slit-like discharge hole in the bottom portion", an "immersion nozzle (Patent Document 13 or 14) having a twisted tape-like swirl vane for generating a swirl flow of molten steel in the nozzle and shaped so that the inner diameter of the nozzle is narrowed by a lower portion of the swirl vane", and so on.

[Patent Document 1]: Japanese Utility Model Publication No. 23091/1995 (Claims 1 and 5)

[Patent Document 2]: Japanese Patent No. 3,050,101 (Claim 1)

[Patent Document 3]: Japanese Patent Laid-Open No. 269913/1994 (Claim 1)

[Patent Document 4]: Japanese Patent Laid-Open No. 130745/1982 (Scope of Claim for a Patent)

[Patent Document 5]: Japanese Patent Laid-Open No. 47896/1999 (Claims 1 and 2)

[Patent Document 6]: Japanese Patent Laid-Open No. 89566/1987 (Claim 1 in Scope of Claim for a Patent)

[Patent Document 7]: Japanese Utility Model Publication No. 72361/1986 (FIGS. 2 to 4)

[Patent Document 8]: Japanese Patent Laid-Open No. 207568/1987 (Claim 1 in Scope of Claim for a Patent)

[Patent Document 9]: Japanese Utility Model Publication No. 22913/1984 (Scope of Claim for a Utility Model Registration)

[Patent Document 10]: Japanese Patent Laid-Open No. 40670/1988 (Claim 1 in Scope of Claim for a Patent)

[Patent Document 11]: Japanese Patent Laid-Open No. 41747/1990 (Scope of Claim for a Patent)

[Patent Document 12]: Japanese Patent Laid-Open No. 285852/1997 (Claim 2)

[Patent Document 13]: Japanese Patent Laid-Open No. 2000-237852 (Claim 1)

[Patent Document 14]: Japanese Patent Laid-Open No. 2000-237854 (FIGS. 1 to 3)

In the aforementioned conventional techniques (see Patent Documents 1 to 8 and 10 to 14) paying attention to the shape of the nozzle inner hole portion, an effect of preventing a drift of the molten steel flow can be expected to a certain degree because a turbulent flow is partially generated. There is however a problem that "deviation in discharge flow rate distribution of molten steel" occurs easily particularly in the discharge hole portion, that is, a minus flow (suction flow) occurs or when a plurality of discharge holes are provided, imbalance occurs in the flowing amount out of each discharge hole.

Description will be further made taking the immersion nozzle as an example. The nozzle has an important role of supplying molten steel into the mold uniformly. Actually, a flow of molten steel in the nozzle is provided as a drift because of flow rate control based on a slide valve. There is a possibility that this will cause a drift of molten steel in the discharge hole and will cause deterioration of cast piece quality because this has influence on the inside of the mold. Besides the flow rate control based on the slide valve, flow rate control based on a stopper and a vortex of molten steel generated in a vessel at the time of discharge of molten steel are causes of occurrence of a drift in the immersion nozzle.

The aforementioned problem can be solved to a certain degree by the shape of the nozzle inner hole portion listed in the conventional techniques. Particularly in the "immersion nozzle having a plurality of step portions" described in the aforementioned Patent Document 1, a drift suppressing effect can be obtained to a certain degree because molten steel passes through the portion where the sectional area of the nozzle is reduced by each step. The height of the step used in practice is about 5 mm. If the height of the step is made higher, the drift suppressing effect can be improved but there is a problem that the amount of passage of molten steel (throughput) is limited by decrease in sectional area of the step portion and increase in frictional resistance of the pipe wall. Also in the "nozzle having semi-spherical concave-convex portions in a surface of a molten metal flow path" described in the aforementioned Patent Document 6, the effect of preventing a drift of molten steel and the effect of suppressing deposition of alumina cannot be always satisfied.

The drift of molten steel in the nozzle inner hole portion causes a "drift of molten steel in the discharge hole portion". The "drift of molten steel in the discharge hole portion" will be described with reference to (A) and (B) in FIG. 1. A molten steel flow a shown in (A) of FIG. 1 is not uniformly discharged from the discharge hole portion (side hole type) but drifts as represented by the solid-line arrow shown in the drawing. That is, a minus flow (suction flow) is generated. As a result, the possibility that mold powder will be involved as represented by the broken-line arrow occurs and causes deterioration of cast piece quality. Not only in the "side hole type" shown in (A) of FIG. 1 but also in a "bottom hole type" straight immersion nozzle 10*b* shown in (B) of FIG. 1, the molten steel flow a' does not uniformly flow out of the discharge hole portion (bottom hole type) so that a drift is generated in the discharge hole portion as represented by the solid-line arrow shown in the drawing. Incidentally, (A) are (B) of FIG. 1 are based on the "water model experiment" of inner pipe straight immersion nozzles 10*a* and 10*b* having discharge hole portions of a "side hole type" and a "bottom hole type" respectively. This phenomenon occurs even in the case where the shape of the nozzle inner hole portion is changed to any one of shapes listed in the conventional techniques. This fact has been confirmed from the "water model experiment" performed by the present inventors.

There is also a problem that alumina is attached and deposited on a space between protrusions disposed in the molten steel flow hole portion of the immersion nozzle in accordance with the method of providing the protrusions when Al killed steel or the like is cast. If alumina is deposited so that the space between the protrusions is filled with alumina, the effect based on the provision of the protrusions is eliminated so that the drift preventing effect is spoilt. At the same time, predetermined throughput (the amount of passage of molten steel per unit time) cannot be kept because the effective sectional area of the inner hole portion is reduced. There is a disadvantage that the nozzle cannot operate. Incidentally, in the method of spraying inert gas which is one of the conventional techniques for preventing alumina from being deposited on the casting nozzle, the alumina deposition preventing effect can be expected but there is a disadvantage that melting loss in the inner surface of the nozzle discharge hole is made severe by the bubbling stirring effect of the inert gas. In addition, there is a problem that cast piece defects occur easily because pinhole defects occurs easily based on gas bubbles in accordance with the size, dispersibility, etc. of the bubbles generated. On the other hand, in the alumina-deposition-free material adapted to the nozzle, the alumina deposition preventing effect can be expected to a certain degree but it cannot be said that the required effect is accomplished.

DISCLOSURE OF THE INVENTION

The present invention is accomplished in consideration of the defects and problems in the background art and an object of the invention is to provide a casting nozzle in which a "drift of molten steel from the inside of the nozzle to a discharge hole portion" caused by flow rate control can be presented and in which alumina can be restrained from being deposited particularly on a space between protrusions of a nozzle inner hole portion.

To achieve the foregoing object, that is, to suppress drifting in the nozzle inner hole portion and prevent deposition of alumina, a casting nozzle according to a first aspect of the invention is a casting nozzle having a molten steel flow hole portion in which a plurality of independent protrusion portions and/or concave portions discontinuous in both directions parallel and perpendicular to a molten steel flowing direction are disposed, the casting nozzle characterized in that each of the protrusion portions and/or concave portions has a size satisfying the following expressions (1) and (2):

$$H \geqq 2 \text{ (unit: mm)} \quad \text{expression (1)}$$

$$L > 2 \times H \text{ (unit: mm)} \quad \text{expression (2)}$$

[in which "H" shows the maximum height of the protrusion portion or the maximum depth of the concave portion, and "L" shows the maximum length of a base portion of the protrusion portion or concave portion].

According to the casting nozzle according to the first aspect of the invention, the aforementioned protrusion portions and/or concave portions are disposed to generate a "turbulent flow" for a flow of molten steel in each of the portions to thereby prevent stagnation and drifting of the molten steel flow in the molten steel flow hole portion to make it possible to prevent deposition of alumina and prevent drifting of molten steel particularly in the discharge hole portion. As a result, continuous casting can be performed easily. In addition, high-quality steel can be cast easily without involving of mold powder.

A casting nozzle according to each of second to twelfth aspects of the invention is characterized in that the following constituent requirement is satisfied.

According to a second aspect of the invention, there is provided a casting nozzle defined in the first aspect, characterized in that each of the protrusion portions and/or concave portions satisfies the following expression (3):

$$L \leqq \pi D/3 \text{ (unit: mm)} \quad \text{expression (3)}$$

[in which "L" shows the maximum length of a base portion of the protrusion portion or concave portion, and "D" shows the inner diameter (diameter) of the nozzle before the protrusion portions or concave portions are disposed (n: the ratio of the circumference of a circle to its diameter)].

According to a third aspect of the invention, there is provided a casting nozzle defined in the first or second aspect, characterized in that the protrusion portions and/or concave portions are disposed so that the inner surface area of a molten steel flow path in a range in which the protrusion portions and/or concave portions are disposed is 102-350% as large as the inner surface area of the molten steel path before disposition of the protrusion portions and/or concave portions.

According to a fourth aspect of the invention, there is provided a casting nozzle defined in any one of the first to third aspects, characterized in that the casting nozzle has a portion where the protrusion portions and/or concave portions are disposed so zigzag that positions are displaced at least in the direction perpendicular to the molten steel flowing direction.

According to a fifth aspect of the invention, there is provided a casting nozzle defined in any one of the first to fourth aspects, characterized in that the protrusion portions and/or concave portions are disposed in the whole or part of the molten steel flow hole portion of the casting nozzle.

According to a sixth aspect of the invention, there is provided a casting nozzle defined in any one of the first to fifth aspects, characterized in that the protrusion portions and/or concave portions are disposed so as to be not higher than a meniscus of the casting nozzle.

According to a seventh aspect of the invention, there is provided a casting nozzle defined in any one of the first to sixth aspects, characterized in that the distance between bases of the protrusion portions in a direction parallel to the molten steel flowing direction is not smaller than 20 mm.

According to an eighth aspect of the invention, there is provided a casting nozzle defined in any one of the first to seventh aspects, characterized in that the height of each of the protrusion portions is 2-20 mm.

According to a ninth aspect of the invention, there is provided a casting nozzle defined in any one of the first to eighth aspects, characterized in that the number of the protrusion portions disposed in the molten steel flowing hole portion is not smaller than 4.

According to a tenth aspect of the invention, there is provided a casting nozzle defined in any one of the first to ninth aspects, characterized in that the "angle between a nozzle inner pipe and a lower end portion of each of the protrusion portions" in a direction parallel to the molten steel flowing direction is not larger than 60°.

According to an eleventh aspect of the invention, there is provided a casting nozzle defined in any one of the first to tenth aspects, characterized in that the protrusion portions are molded so as to be integrated with a body of the casting nozzle.

According to a twelfth aspect of the invention, there is provided a casting nozzle defined in any one of the first to eleventh aspects, characterized in that the casting nozzle is an immersion nozzle for continuously casting steel.

BRIEF DESCRIPTION OF THE DRAWINGS

In FIG. 1, (A) is a typical view of an immersion nozzle (side hole type) having a straight inner pipe, and (B) is a typical view of an immersion nozzle (bottom hole type) having a straight inner pipe.

FIG. 2 is a view showing Examples 1 to 8 of the invention.

FIG. 3 is a view showing Comparative Examples 1 to 8.

In FIG. 6, (A) is a sectional view showing a right lower portion of the apparatus, and (B) is a view showing the shape of an opening in a discharge hole surface x in (A).

FIG. 7 is a view showing "results of measurement of discharge flow rates" measured at the points (1) to (9) in FIG. 6 in each of immersion nozzles according to Comparative Example 1 and Example 1.

In FIG. 9, (A) is a sectional view cut vertically in parallel to the molten steel flowing direction and showing the immersion nozzle according to Example 10, and (B) and (C) are sectional views cut vertically in parallel to the molten steel flowing direction and showing the immersion nozzles according to Comparative Examples 11 and 12, respectively. In FIG. 9, (D) is a view showing a section of each protrusion portion taken in parallel to the molten steel flowing direction in the immersion nozzle (Example 10) depicted in (A), and (E) is a view showing a section of each protrusion portion taken in parallel to the molten steel flowing direction in the immersion nozzle (Comparative Example 12) depicted in (C). In FIG. 9, (D) and (E) are views for explaining results of a "water model experiment" for the immersion nozzles according to Example 10 and Comparative Example 12.

In FIG. 10, (A) shows an immersion nozzle according to Example 11, and (B) shows an immersion nozzle according to Comparative Example 13. In FIG. 10, (C) is a view showing a "result of the water model experiment" for Example 11, and (D) is a view showing a "result of the water model experiment" for Comparative Example 13.

FIG. 11 is a view showing the "sectional shape (sectional shape cut in parallel to the molten steel flowing direction) of each protrusion portion" disposed in each of immersion nozzles according to Examples 12 to 16 and Comparative Examples 14 to 18 and further showing the "presence or absence of stagnation just under each protrusion" and "straightening effect".

In FIG. 12, (A) is a view showing an example of calculation at H=7 mm, (B) is a view showing an example of calculation at H=11 mm, and (C) is a view showing an example of calculation at H=18 mm.

In FIG. 13, (A) shows an example in which spherical protrusions are disposed, and (B) shows an example in which elliptical protrusions are disposed.

In FIG. 14, (A) shows an example in which the independent protrusion portions are disposed above a meniscus, (B) shows an example in which the independent protrusion portions are disposed in a range ranging a portion above the meniscus to a portion below the meniscus, (C) shows an example in which the independent protrusion portions are disposed on the whole surface of the molten steel flow hole portion of the nozzle, and (D) shows an example in which the independent protrusion portions are disposed below the meniscus.

BEST MODE FOR CARRYING OUT THE INVENTION

Figure 1A:
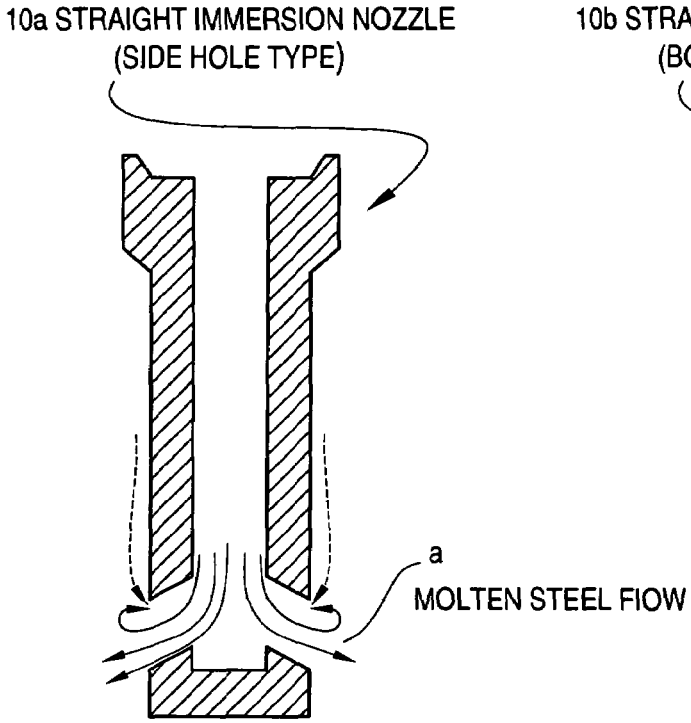
FIG. 1 is a typical view for explaining a drift of molten steel in a discharge hole portion of an immersion nozzle.

A mode of a casting nozzle according to the invention will be described below. Before the description, the casting nozzle according to the invention will be described in more detail inclusive of the technical significance of the aforementioned expressions (1) and (2) specified by the invention.

The reason why the maximum height or maximum depth (H) of the protrusion portion or concave portion is set to satisfy "H≧2 (mm)" in the expression (1) in the invention is that the aforementioned operation and effect are obtained, that is, a "turbulent flow" is generated for a flow of molten steel particularly in the portion of provision of the protrusion portions and/or concave portions (hereinafter also referred to as "concave-convex portions" simply) to prevent the flow of molten steel from stagnating or drifting in the molten steel flow hole portion to thereby prevent alumina from being deposited. If the maximum height or maximum depth (H) is smaller than 2 mm, the alumina deposition suppressing effect can be hardly obtained undesirably because it is difficult to generate the "turbulent flow" for the flow of molten steel in the concave-convex portions and it is difficult to obtain the straightening effect.

The fact that the aforementioned effect can be hardly obtained when the maximum height or maximum depth (H) of each of the protrusion portions is smaller than 2 mm will be described specifically on the basis of Comparative Example 5 which will be described later. Comparative Example 5 is a nozzle of "H=1 mm". As shown in FIG. 3 which will be described later (see the column of Comparative Example 5), drifting of left and right discharge flows was observed in a water model experiment of this nozzle, and a minus flow (suction flow) was observed in a result of flow rate measurement in the discharge hole portion. Also in a test for an actual machine, the amount of alumina deposited on the inner pipe was as large as "10 mm" (see the column of "Comparative Example 5" in FIG. 3 which will be described later). Accordingly, it was understood that the effect based on provision of the protrusions cannot be observed in the case of "H=1 mm".

The reason why the maximum length (L) of the base portion is set to satisfy "L>2×H (mm)" in the expression (2) in the invention is that (1) stagnation under the protrusions can be prevented and (2) the protrusions can be prevented from dropping out due to collision with the flow of molten steel. If the maximum length (L) of the base portion is not larger than "2×H" mm, it is difficult to obtain the effects (1) and (2) and it is difficult to obtain the "molten steel drift preventing effect", undesirably.

Figure 12A:
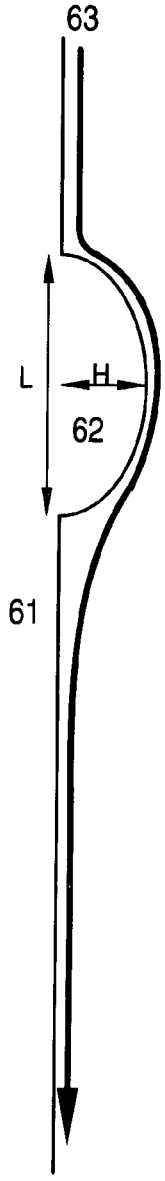
FIG. 12 is a view showing results of the "relation between the height (H) of each protrusion and the length (L) of a base portion of the protrusion" examined by a fluid calculation software program in the condition that the length (L) is fixed to "L=22 mm".
Figure 12B:
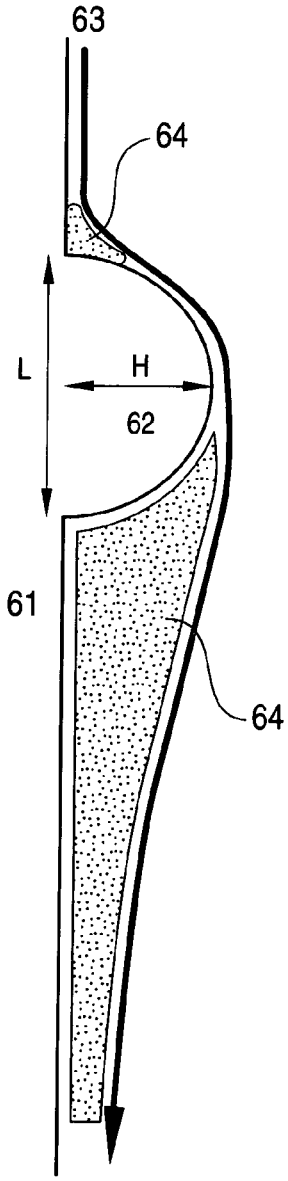
Figure 12C:
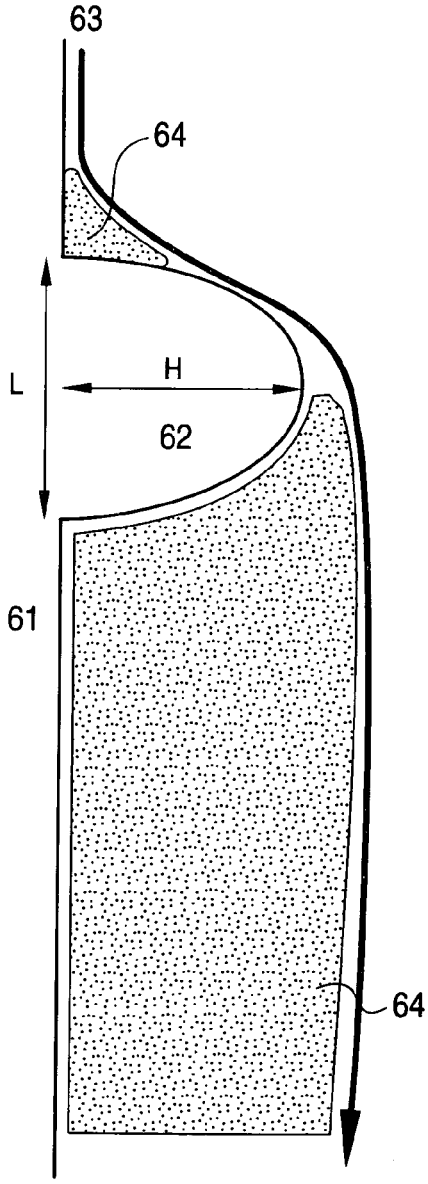

For confirming the "(1) stagnation preventing effect", FIG. 12 shows a result of examination into the "relation between the height (H) of the protrusion and the length (L) of the base portion of the protrusion" based on a fluid calculation software program. Here is shown an example of calculation in the case where the height (H) of each of the protrusions is changed to "(A): H=7 mm, (B): H=11 mm and (C): H=18 mm" while the length (L) of the base portion of each of the protrusions is fixed to "L=22 mm". As is obvious from FIG. 12, no stagnation portion can be observed on and under the protrusions in (A) of FIG. 12 satisfying the "expression (2): L>2×H (mm)" whereas a stagnation portion 64 can be observed in (B) and (C) of FIG. 12 not satisfying the expression (2). That is, it is guessed that when the relation between the height (H) of the protrusion and the length (L) of the base portion does not satisfy "L>2×H", the stagnation portion 64 is generated so that alumina is deposited (attached) thereon at the time of casting in the actual machine. [Incidentally, in FIG. 12, the reference numeral 61 designates a body (inner pipe side operating surface) of the nozzle; 62, a protrusion portion; and 63, a result of fluid calculation (a flow of molten steel)]. The relation between the height (H) of the protrusion and the length (L) of the base portion "the expression (2): L>2×H" will be described more specifically on the basis of Examples and Comparative Examples which will be described later. In each of Comparative Examples 3, 4, 6, 7 and 8 not satisfying the relation of "the expression (2): L>2×H", the amount of an alumina inclusion deposited is "5-7 mm" (see FIG. 3 which will be described later). In each of Examples 1 to 8, there is obtained a good result that the amount is "not larger than 3 mm" (see FIG. 2 which will be described later). The "(2) prevention of the protrusion from dropping out", that is, "strength of the protrusion" will be described specifically on the basis of Examples and Comparative Examples which will be described later. In each of Examples 1 to 8 satisfying the "expression (2): L>2×H", damage (dropout) of the protrusion due to collision with the flow of molten steel was not observed in a product cast by the actual machine (see FIG. 2 which will be described later). On the contrary, in each of Comparative Examples 3, 4, 6 and 7, dropout of the protrusion was observed (see FIG. 3 which will be described later). Each of Comparative Examples does not satisfy the "expression (2): L>2×H". For keeping the strength of the protrusion, it is important to satisfy "L>2×H". Incidentally, in FIG. 2 (Examples 1 to 8) and FIG. 3 (Comparative Examples 1 to 8), the relation between the height (H) of the protrusion and the length (L) of the base portion is expressed in "L/H". For satisfying the "expression (2): L>2×H" specified by the invention, it is necessary that "L/H" is a value (2<) larger than 2.

In the casting nozzle according to the invention, the shape of each of the protrusion portions and/or concave portions is not particularly limited as long as each of the protrusion portions and/or concave portions has a size satisfying the expressions (1) and (2). Any shape such as a semi-spherical shape, an elliptical shape, an approximately polygonal pyramid shape, etc. may be used or any suitable combination of these shapes may be provided. Incidentally, the term "approximately polygonal pyramid shape" in the invention means a shape formed from three or more line segments and having a top end portion shaped like an acute angle, a flat surface or a curved surface with a ridge shaped like a line or a curve (e.g. see "Shape of Protrusion" in Examples 6 to 8 shown in FIG. 2 which will be described later).

The casting nozzle according to the invention is characterized in that dimensions satisfying the expressions (1) and (2) are provided. As a preferred embodiment thereof, the maximum length L (mm) of the base portion of each of the concave-convex portions is set to be not larger than ⅓ as large as the length of the circumference of the nozzle with the inner diameter D (mm) before provision of the concave-convex portions, that is, the following expression (3) is satisfied.

$$L \leqq \pi D/3 \text{ (unit: mm)} \qquad \text{expression (3)}$$

[in which "L" shows the maximum length of the base portion of each of the protrusion portions or concave portions, and "D" shows the inner diameter (diameter) of the nozzle before provision of the protrusion portions or concave portions (π: the ratio of the circumference of a circle to its diameter)].

Figure 13A:
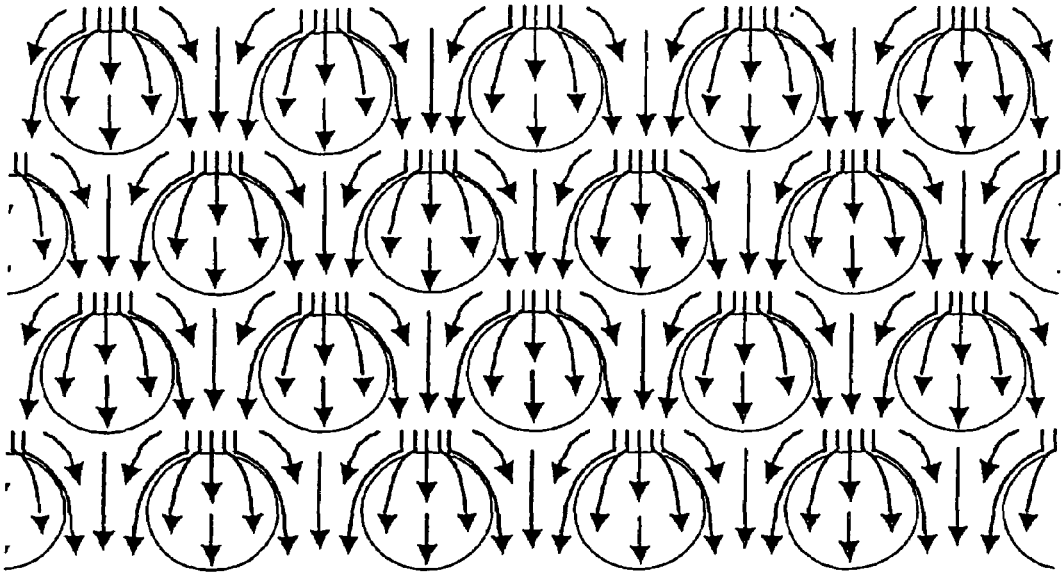
FIG. 13 is an expanded view of an inner pipe of a nozzle in which a plurality of independent protrusions are disposed.
Figure 13B:
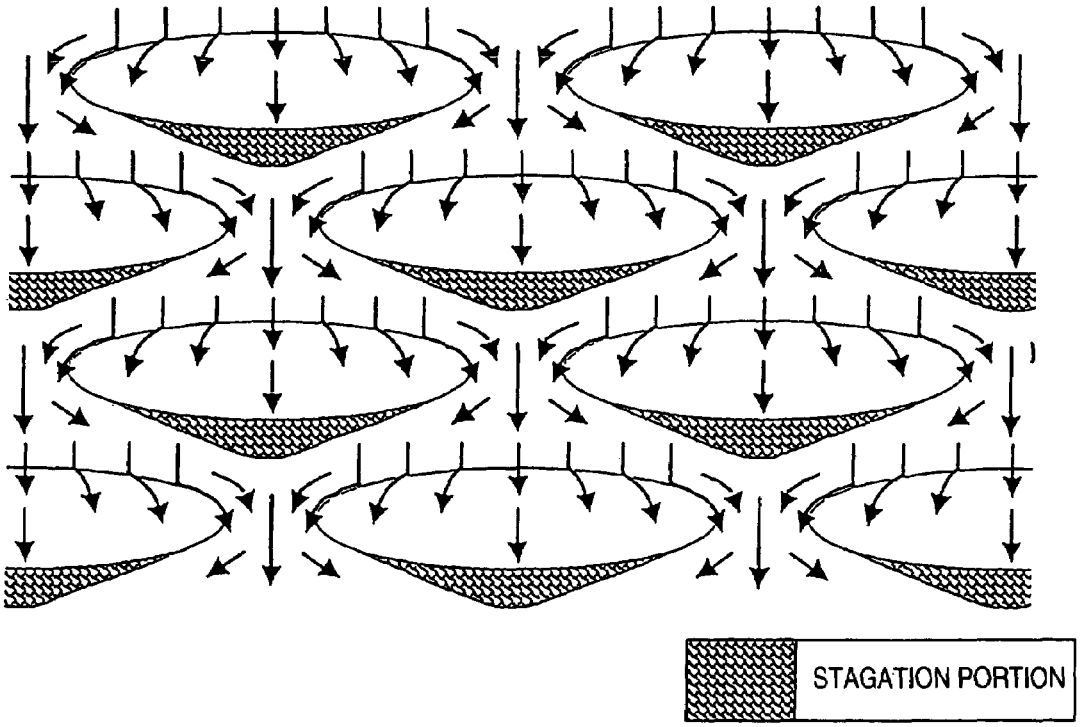

The operation and effect of the expression (3) will be described specifically on the basis of FIG. 13. FIG. 13 is an extend elevation of the inner pipe of a nozzle provided with a plurality of independent protrusions. (A) shows an example of provision of spherical protrusions (satisfying the expression (3)). (B) shows an example of provision of elliptical protrusions (not satisfying the expression (3)). A transparent acrylic nozzle was subjected to a water model experiment. As a result, flows represented by the "arrows" in (A) and (B) of FIG. 13 were confirmed.

In the case of (A) of FIG. 13 which shows an example of provision satisfying the "expression (3): L≦πD/3", an oblique flow from an adjacent protrusion goes to just under one protrusion so smoothly that no stagnation portion is generated. On the contrary, in the case of (B) of FIG. 13 which does not satisfy the expression (3), a stagnation portion is generated just under each protrusion because an oblique flow from an adjacent protrusion can hardly reach just under one protrusion.

The flow of molten steel falling down collides with each protrusion, so that the direction of the flow changes to thereby generate a local turbulent flow. Originally, the flow of molten steel hardly goes to just under one protrusion physically. Therefore, the presence of a flow of molten steel colliding with a protrusion adjacent to the protrusion or the presence of a flow induced and inverted by a protrusion obliquely below the protrusion is important. On the contrary to independent protrusions, a nozzle having a conventional stepped structure (see the aforementioned Patent Document 1) will be considered. The step comes under the category of a ring-like protrusion. Because the flow of molten steel stagnates just under the ring-like protrusion, a stagnation portion is generated. There is a disadvantage that an alumina inclusion is easily deposited on the stagnation portion when the actual machine is used. The maximum length (L) of the base portion of each of the concave-convex portions must be considered in order to improve this point. The present inventors have found from the result of the water model experiment that it is preferable that the "expression (3): L≦πD/3" is satisfied. [Incidentally, in the case of an oval shape (nozzle having an upper portion shaped like a general circle, and a lower portion enlarged like an ellipse or an oblong) used in a thin slab continuous casting machine or the like, "D" is set as the maximum inner diameter of an enlarged region of the lower portion of the inner pipe].

In accordance with the provision of the concave-convex portions in the molten steel flow hole portion according to the invention, the inner surface area of the molten steel flow path changes compared with the reference structure before the provision. It is preferable that the inner surface area of the molten steel flow path after the provision is 102-350% as large as that before the provision. More preferably, the rate is 105-300%. Most preferably, the rate is 105-270%. If the rate is lower than 102%, the required effect based on the provision of the protrusion portions and/or concave portions which are characteristic of the invention can be hardly obtained. If the rate is higher than 350%, the inside of the molten steel flow hole is so narrowed that a sufficient flow rate of molten steel can be hardly kept, undesirably.

The provision of the protrusion portions and/or concave portions, which are characteristic of the invention, in the inner hole portion of the nozzle is not particularly limited but it is preferable that the protrusion portions or concave portions are disposed so zigzag as to be displaced in a direction perpendicular to the molten steel flowing direction. That is, as a preferred embodiment of the casting nozzle according to the invention, the casting nozzle has a portion in which the protrusion portions and/or concave portions are disposed so zigzag as to be displaced at least in a direction perpendicular to the molten steel flowing direction.

The protrusion portions and/or concave portions which are characteristic of the invention can be disposed in the whole or part (e.g. ranging from the upper end portion of the nozzle discharge hole to the center portion of the upper portion) of the molten steel flow hole portion of the nozzle. The positions where the protrusion portions and/or concave portions are disposed are not limited but it is preferable that the protrusion portions and/or concave portions are disposed so as to be not higher than the meniscus (the surface or liquid level of molten steel in the mold), that is, they are disposed in an immersion portion.

Figures 14A, 14B, 14C, 14D:
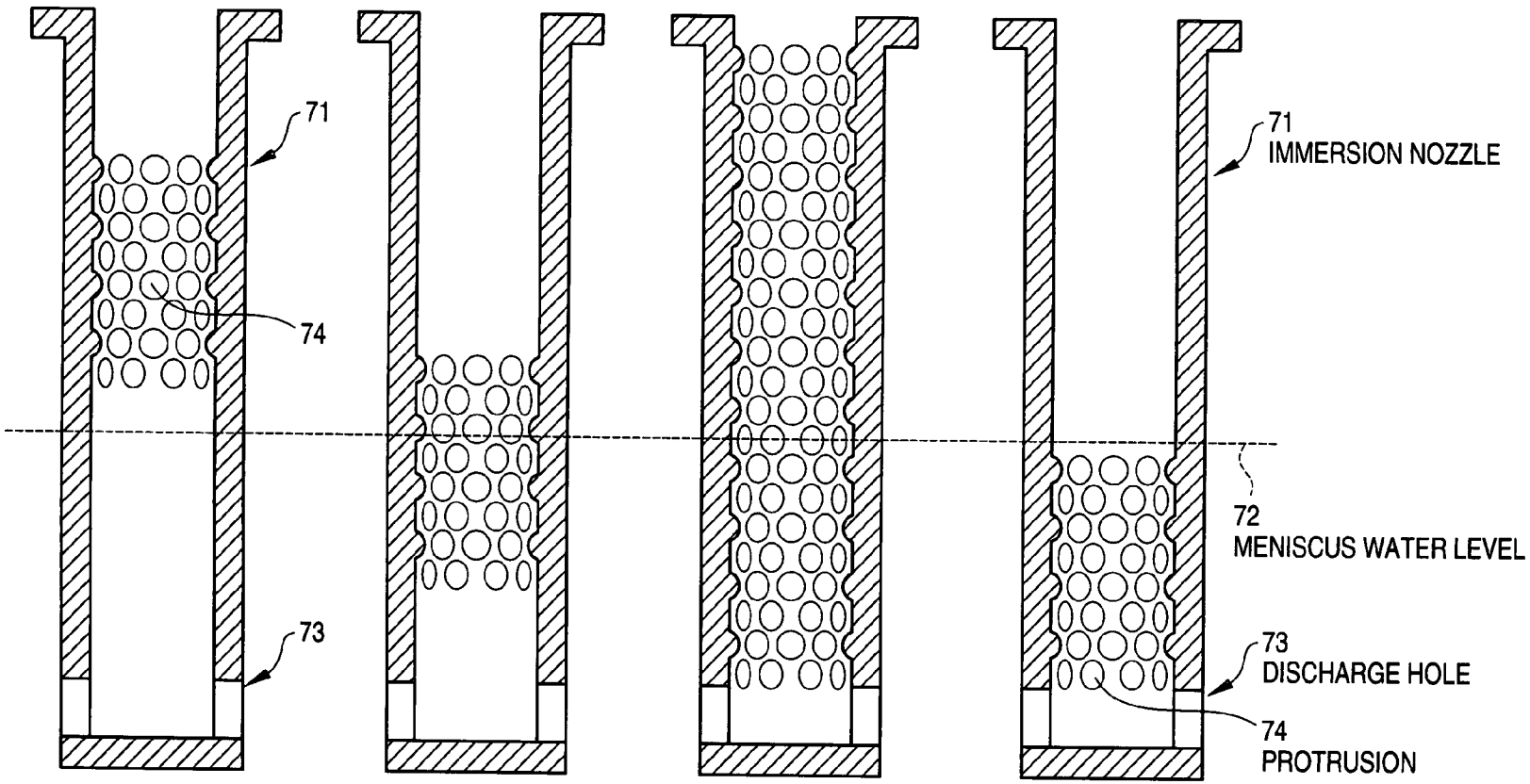
FIG. 14 is a view showing places where independent protrusion portions are disposed.

Preferred positions where the protrusion portions and/or concave portions being characteristic of the invention are disposed will be described below. The prevent inventors have made a water model experiment by using the immersion nozzles (A) to (D) shown in FIG. 14. As a measurement item, a flow rate from each discharge hole was measured with a propeller flowmeter 51 by a method (see the later description) shown in FIG. 6. As a result, in (A) of FIG. 14 in which the protrusions 74 were disposed only above the meniscus 72 of the immersion nozzle 71, a minus flow (suction flow) was observed at two of flow rate measurement points of the left discharge hole 73. However, in each of (B) to (D) of FIG. 14 in which the protrusions 74 were disposed to be not higher than the meniscus 72, that is, the protrusions 74 were disposed to reach the immersion portion, there was no minus flow observed. In terms of positions of the protrusions 74 disposed, it is apparent from this fact that the protrusions 74 are preferably disposed so as to be not higher than the meniscus 72, that is, the protrusions 74 are preferably disposed to reach the immersion portion.

In the invention, it is preferable that the distance E (see FIG. 8) between bases of the protrusions in a direction (vertical direction) parallel to the molten steel flowing direction is not smaller than 20 mm, that is, even the shortest distance is not smaller than 20 mm. In a range in which the height H of each protrusion is not larger than 20 mm, there is no stagnation portion generated between the protrusions as long as the distance E between the protrusions in a direction (vertical direction) parallel to the molten steel flowing direction can be kept not smaller than 20 mm. Accordingly, there is no alumina deposited between the protrusions. The distance E is selected to be preferably not smaller than 25 mm, more preferably not smaller than 30 mm. Incidentally, it is preferable that the height H (see FIG. 8) of each protrusion is selected to be not larger than 20 mm in order to secure throughput (the amount of passage of molten steel per unit time).

In the invention, it is also preferable that four or more protrusion portions are disposed in the molten steel flow hole portion of the casting nozzle. If the number of protrusion portions is three or less, the effect of straightening molten steel flowing down in the molten steel flow hole portion cannot be expected so that a drift may occur easily.

In the casting nozzle according to the invention, when the protrusion portions each having a height not smaller than 2 mm (preferably, 2 to 20 mm) are disposed, it is preferable that the "angle between the nozzle inner pipe and the lower end portion of each protrusion" in a direction (i.e. a vertical section) parallel to the molten steel flowing direction, that is, the "angle of the lower end of each protrusion portion" is not larger than 60°. [The aforementioned "nozzle inner pipe" means the wall surface of an original inner pipe before the provision of the protrusions, and the angle between the wall surface of the inner pipe and the lower end portion of each protrusion is referred to as "angle of the lower end of each protrusion" in this specification.

When illustrated, the "angle of the lower end of each protrusion portion" is, for example, equivalent to "θ" shown in (D) or (E) of FIG. 9. When the lower portion of each protrusion in a direction (i.e. vertical section) parallel to the molten steel flowing direction is shaped like a circular arc, the "angle of the lower end of each protrusion portion" is set to be an angle (see "θ" in Example 16 in FIG. 11) of a line tangential to the circular arc lower end portion. In a range in which the "angle of the lower end of each protrusion portion" is not larger than 60°, there is no stagnation portion generated just under each protrusion portion. Accordingly, there is no alumina deposited just under the protrusion portion. Examples of fluid calculation results are shown in (D) and (E) of FIG. 9. Incidentally, (D) of FIG. 9 shows an example of "θ: 45°", and (E) of FIG. 9 shows an example of "θ: 70°". If the "angle θ of the lower end of each protrusion portion" is larger than 60°, a stagnation portion 43 is generated just under the protrusion portion as shown in (E) of FIG. 9.

Although it is preferable that the "angle θ of the lower end of each protrusion portion" is not larger than 60°, the angle θ may be allowed to be out of the range if the height h (the height h toward the center of the nozzle inner pipe) of the lower end portion is smaller than 2 mm as shown in Example 14 or 15 in FIG. 11. In this case, the angle just above the region may be selected to be not larger than 60°. Incidentally, the "angle θ of the lower end of each protrusion portion" is selected to be preferably not larger than 50°, more preferably not larger than 40°, especially preferably not larger than 30°.

The protrusion portions in the invention are preferably molded so as to be integrated with the body of the casing nozzle. Another method such as fitting than integral molding is not preferred because there is a possibility that molten steel or steel inclusion will penetrate into a gap between each protrusion portion and the body to cause dropout of the protrusion portion.

Figure 4:
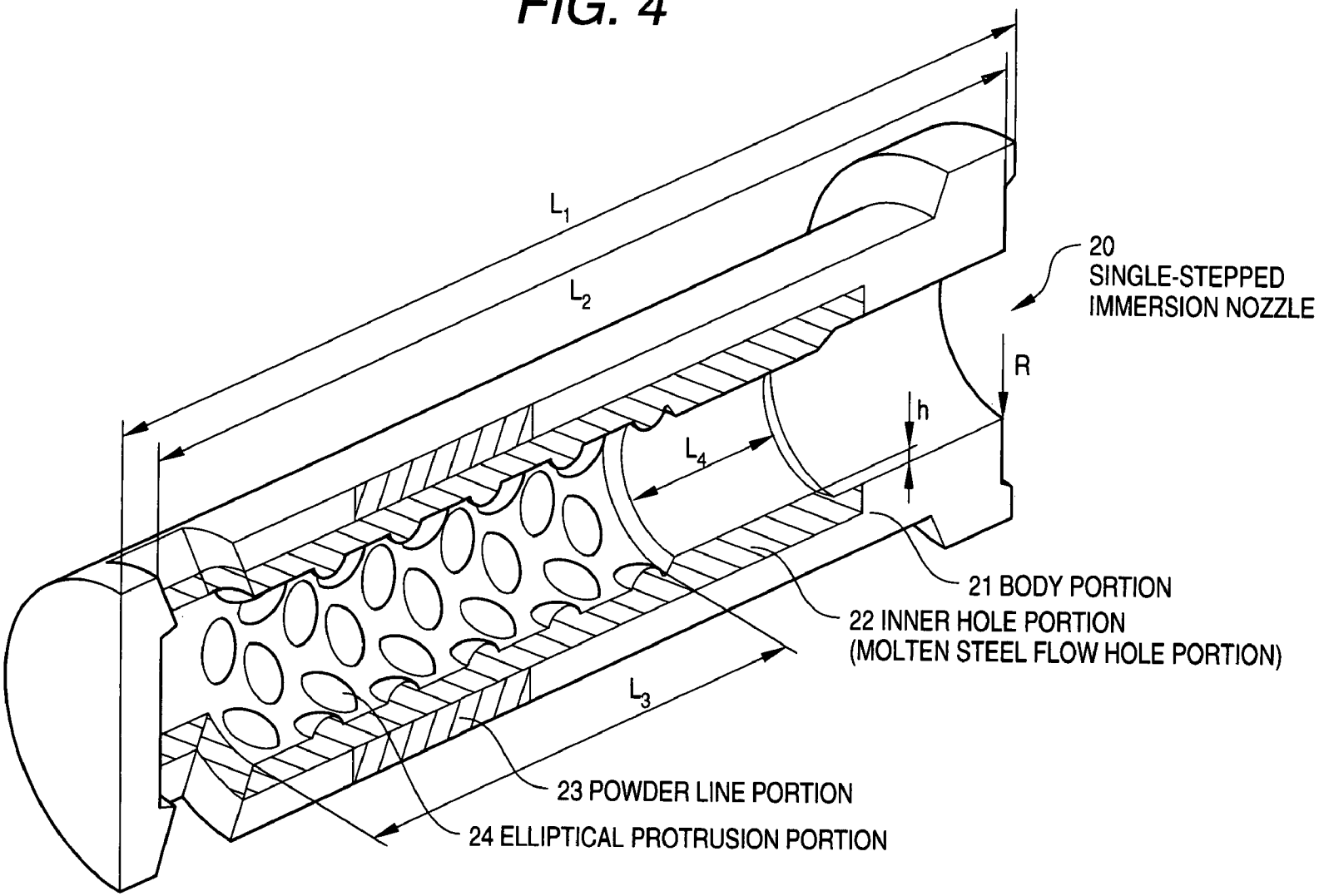
FIG. 4 is a sectional perspective view of an immersion nozzle according to an embodiment (Example 1) of the invention.
Figure 5:
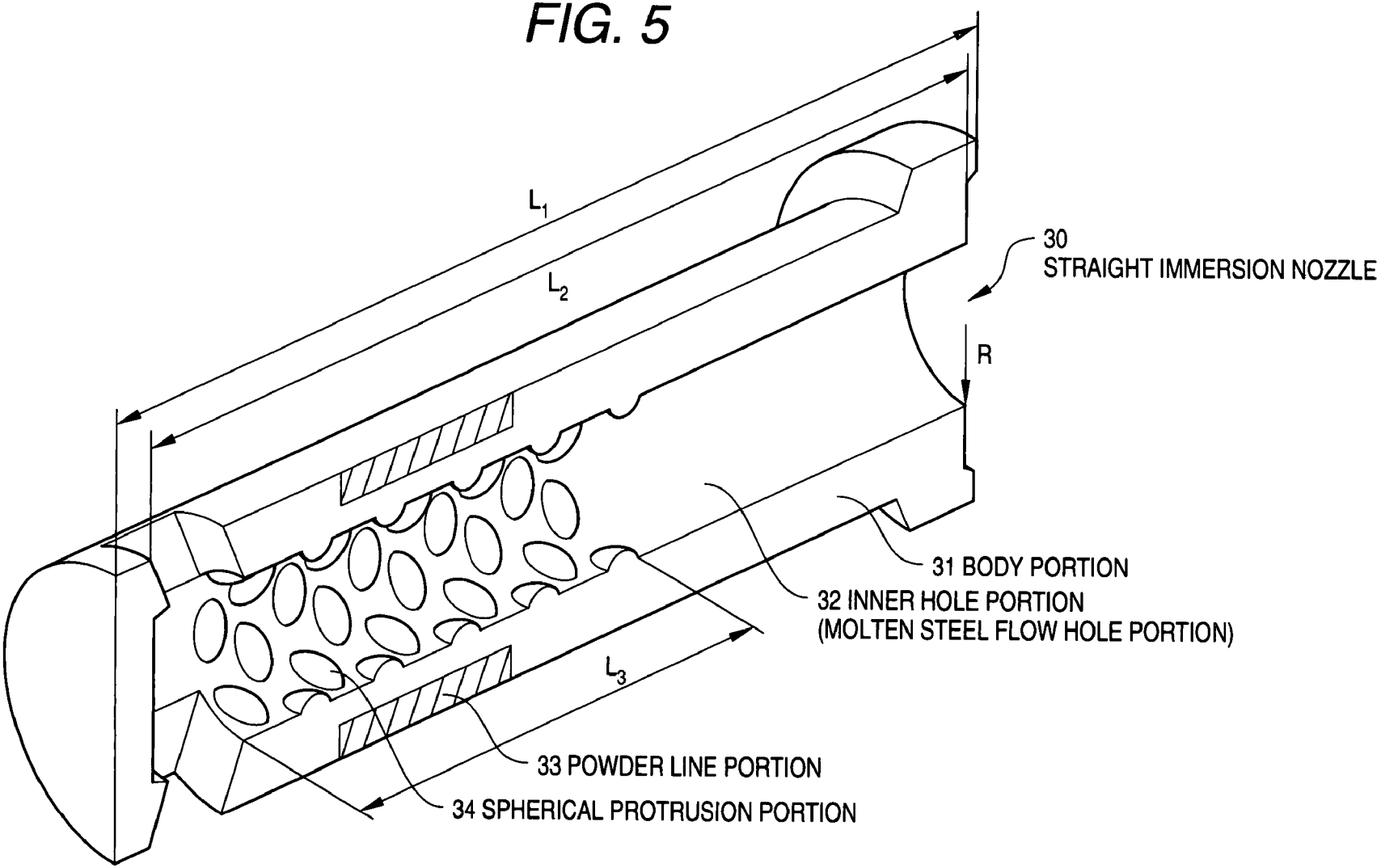
FIG. 5 is a sectional perspective view of an immersion nozzle according to an embodiment (Example 2) of the invention.

Next, an embodiment of the casting nozzle according to the invention will be described with reference to FIGS. 4 and 5. FIG. 4 is a sectional perspective view of the immersion nozzle as an embodiment of the invention and shows an example in which a plurality of ellipsoidal protrusion portions 24 are disposed in an inner hole portion (molten steel flow hole portion) 22 of a single-stepped immersion nozzle 20. FIG. 5 is a sectional perspective view of the immersion nozzle as another embodiment of the invention and shows an example in which a plurality of spherical protrusion portions 34 are disposed in an inner hole portion (molten steel flow hole portion) 32 of a straight immersion nozzle 30. Incidentally, in FIGS. 4 and 5, the reference numerals 21 and 31 designate body portions; and 23 and 33, powder line portions. Further, $L_1$ shows the total length of the immersion nozzle, $L_2$ shows the total length of the inner hole portion, $L_3$ shows the length of a place where the protrusion portions are disposed, $L_4$ shows the length of the step, h shows the height of the step, and R shows the radius of the inner hole portion.

The conventional method of spraying inert gas may be used together with the aforementioned single-stepped immersion nozzle 20 in which the ellipsoidal protrusion portions 24 are disposed or with the aforementioned straight immersion nozzle 30 in which the spherical protrusion portions 34 are disposed. Accordingly, an effect of the method of spraying inert gas against alumina deposition can be improved. Use of this method can be contained in the invention.

Figure 1B:
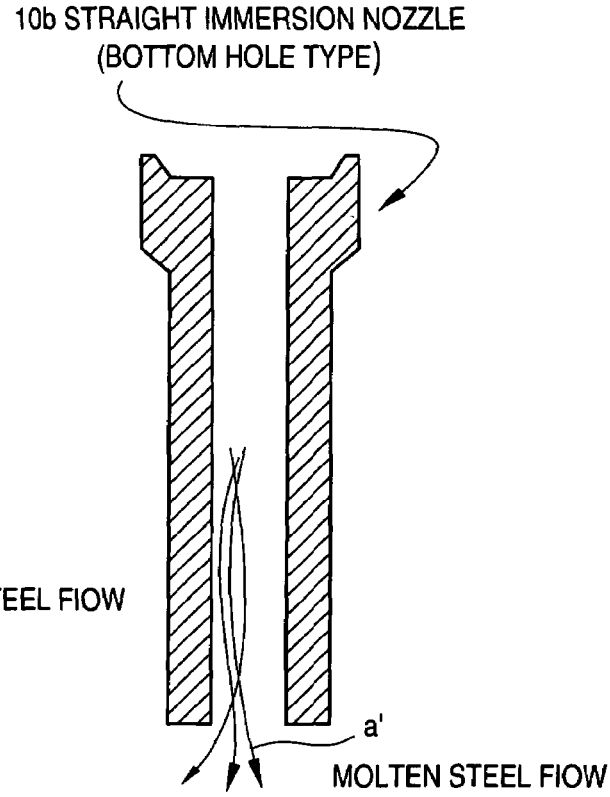

Although the example where the invention is applied to a "side hole type" immersion nozzle as shown in FIG. 4 or 5 has been described above chiefly, the invention may be applied to a "bottom hole type" immersion nozzle as shown in (B) of FIG. 1 or may be applied to an immersion nozzle of a "type with a nozzle inner diameter reduced toward the discharge hole portion" or an immersion nozzle of a "type with a section flattened toward the discharge hole portion". The invention may be further applied to an immersion nozzle having continuous steps" known heretofore.

The invention may be further applied to various kinds of casting nozzles such as a long nozzle, a tundish nozzle, a semi-immersion nozzle, a straightening nozzle, a change nozzle, a ladle nozzle, an insert nozzle, an injection nozzle, etc. besides the immersion nozzle. These nozzles are effective in preventing adhesion on the inner surface of the flow hole and straightening a flow in the flowhole. Particularly, in a nozzle having a discharge hole portion located to be higher than the level of molten steel, molten steel out of the discharge hole is dispersed as if it was sprayed (so-called molten steel scattering) and, accordingly, the scattered molten steel is deposited as base metal on the peripheral equipment. There is a problem that labor must be required for removing the scattered molten metal. When the invention is applied to these problems, production efficiency can be improved because the "molten metal scattering" can be reduced as a result of the aforementioned effect.

The material of each of the "protrusion portions and/or concave portions" being characteristic of the invention is not limited. Any self-evident material can be used in the invention. Examples of the material include: carbon-containing refractory materials such as $Al_2O_3$—C, MgO—C, $Al_2O_3$—MgO—C, $Al_2O_3$—$SiO_2$—C, CaO—$ZrO_2$—C, $ZrO_2$—C, etc.; and carbonless refractory materials such as $Al_2O_3$, MgO, spinel, CaO—$ZrO_2$, etc.

EXAMPLES

Although the invention will be described below specifically on the basis of Examples of the invention and Comparative Examples, the invention is not limited by the following Examples 1 to 16.

Example 1 (see FIG. 4)

Example 1 is an example in which a plurality of ellipsoidal protrusion portions are disposed in an inner hole portion of a single-stepped immersion nozzle. The following immersion nozzle was produced (see FIG. 4 which has been described above).

Shape of Immersion Nozzle
- : single-stepped immersion nozzle with a length ($L_4$) of 120 mm and a height (h) of 5 mm
- : immersion nozzle total length $L_1$=800 mm
- : inner hole portion total length $L_2$=770 mm
- : inner hole portion radius R=40 mm Material of Immersion Nozzle
- : body portion 25 wt % of graphite, 50 wt % of $Al_2O_3$, 25 wt % of $SiO_2$
- : powder line portion 13 wt % of graphite, 87 wt % of $ZrO_2$
- : inner hole portion 5.5 wt % of carbon, 94.5 wt % of $Al_2O_3$ Ellipsoidal Protrusion Portions
- : arrangement position Ellipsoidal protrusion portions were disposed in a length of 350 mm ranging upward from the upper end portion of the discharge hole. ($L_3$=350 mm)
- : 54 ellipsoidal protrusion portions
- : maximum height 8 mm
- : base portion maximum length 32 mm
- : material low carbon material the same as that of the inner hole portion of the immersion nozzle (The increasing rate of the surface area of the nozzle inner hole portion in the region of arrangement of the ellipsoidal protrusion portions to the "surface area of the nozzle inner hole portion in the region before the arrangement of the ellipsoidal protrusion portions") was 116%).

Comparative Example 1

In the aforementioned Example 1, an immersion nozzle having no ellipsoidal protrusion portion arranged was produced. This was made as an immersion nozzle according to Comparative Example 1 (to be compared with Example 1).

(Water Model Experiment)

Figures 6A, 6B:
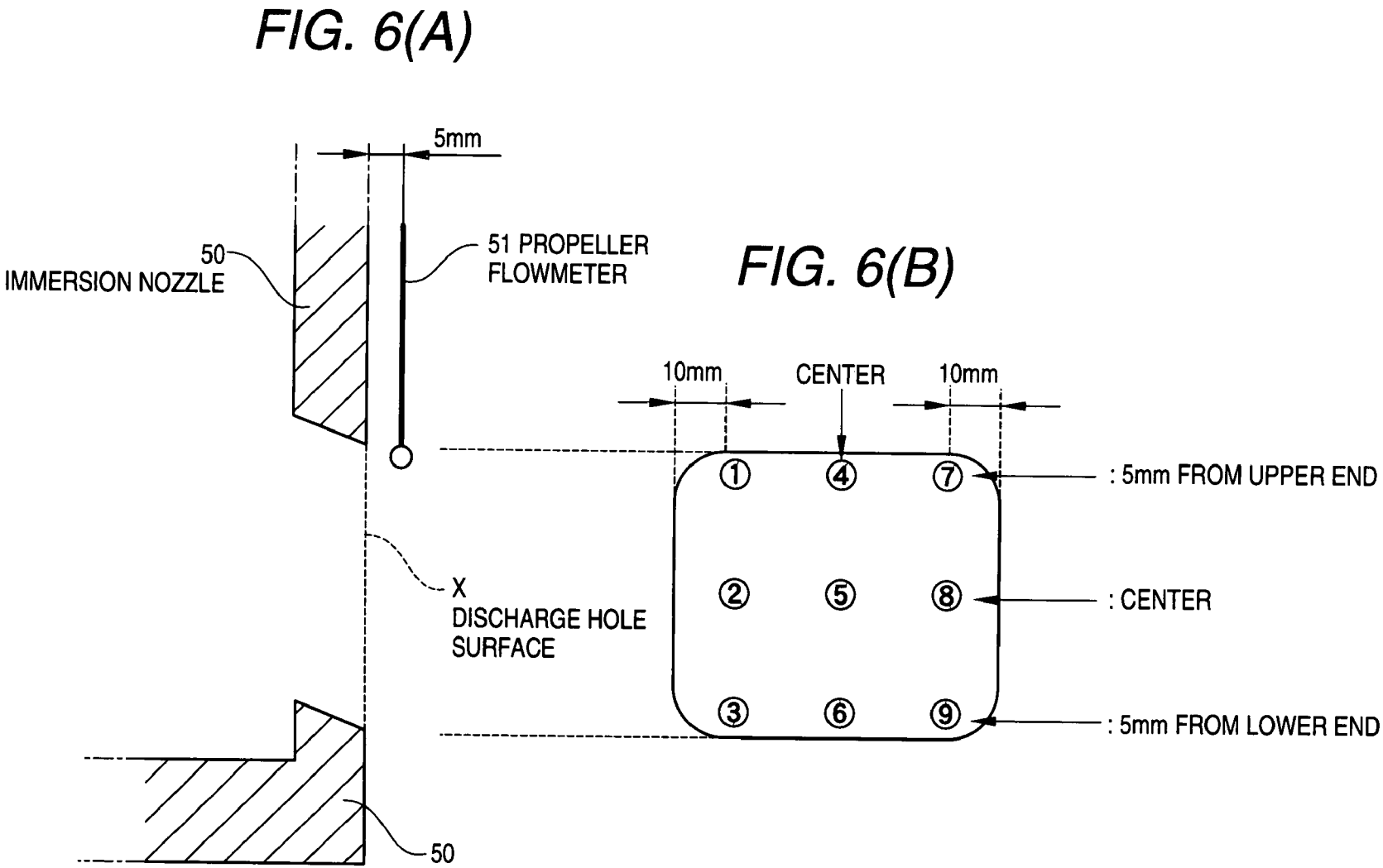
FIG. 6 is a view for explaining points (1) to (9) at which discharge flow rates are measured in a water model experiment apparatus.

Each of the immersion nozzles according to Example 1 and Comparative Example 1 was used and a water model experiment was performed. In the water model experiment, as shown in FIG. 6, the discharge flow rate from the discharge hole of each immersion nozzle 50 was measured with the propeller flowmeter 51. Incidentally, FIG. 6 is a view for explaining discharge flow rate measurement points (1) to (9) in a water model experiment apparatus. In FIG. 6, (A) is a sectional view showing a right lower portion of the apparatus, and (B) is a view showing the shape of an opening in the discharge hole surface x of (A). In the experiment, the amount of water was adjusted so as to be equivalent to 3 (ton/min), 5 (ton/min) or 7 (ton/min) as the amount of passage of molten steel (throughput) in the immersion nozzle 50. Discharge flow rates from the left and right discharge holes were measured simultaneously with two propeller flowmeters 51. FIG. 7 shows a result of measurement of the discharge flow rates.

As a result of the water model experiment, in the case where the single-stepped immersion nozzle according to Comparative Example 1 was used, a "minus flow (suction flow)" was generated in the discharge flow rate from each of the left and right discharge holes as shown in FIG. 7 when the throughput was 3 (ton/min) or 5 (ton/min). On the contrary, in the immersion nozzle according to Example 1 in which the ellipsoidal protrusion portions were provided in the inner hole portion of the single-stepped immersion nozzle, there was no minus flow generated, and variation in the discharge flow rate was reduced.

If a minus discharge flow rate was generated, there was a risk that mold powder put in the mold would be involved, and there arose a problem that melting loss occurred in the peripheral portion of the discharge hole. In the immersion nozzle according to Example 1, the generation of such a minus flow was eliminated. In the single-stepped immersion nozzle according to Comparative Example 1, the difference between the discharge flow rates from the left and right discharge holes was large. On the other hand, in the immersion nozzle according to Example 1, the difference was reduced so that a more uniform discharge flow could be obtained.

Example 2 (see FIG. 5)

Example 2 is an example in which a plurality of spherical (globular) protrusion portions are disposed in an inner hole portion of a straight immersion nozzle. The following immersion nozzle was produced (see FIG. 5 which has been described above).

Shape of Immersion Nozzle
- : immersion nozzle having a straight inner pipe
- : immersion nozzle total length $L_1$=900 mm
- : inner hole portion total length $L_2$=870 mm
- : inner hole portion radius R=45 mm Material of Immersion Nozzle
- : body portion 25 wt % of graphite, 50 wt % of $Al_2O_3$, 25 wt % of $SiO_2$
- : powder line portion 13 wt % of graphite, 87 wt % of $ZrO_2$ Spherical (Globular) Protrusion Portions
- : arrangement position Spherical protrusion portions were disposed in a length of 450 mm ranging upward from the upper end portion of the discharge hole. ($L_3$=450 mm)
- : 70 spherical protrusion portions
- : maximum height 10 mm
- : base portion maximum length 27 mm
- : material the same as that of the body portion of the immersion nozzle (The increasing rate of the surface area of the nozzle inner hole portion in the region of arrangement of the spherical protrusion portions to the "surface area of the nozzle inner hole portion in the region before the arrangement of the spherical protrusion portions") was 114%).

Comparative Example 2

In the aforementioned Example 2, an immersion nozzle having no spherical (globular) protrusion portion arranged was produced. This was made as an immersion nozzle according to Comparative Example 2 (to be compared with Example 2).

(Water Model Experiment)

Each of the immersion nozzles according to Example 2 and Comparative Example 2 was used and a water model experiment was performed in the same manner as in each of the immersion nozzles according to Example 1 and Comparative Example 1. The result was the same as the result of the water model experiment for the immersion nozzles according to Example 1 and Comparative Example 1.

The immersion nozzles according to Examples 1 and 2 were subjected to a practical test on the basis of the result of the water model experiment for Examples 1 and 2. As a result, molten steel was restrained from drifting in the mold, and alumina was prevented from being deposited on the nozzle inner hole portion. The effectiveness of the immersion nozzles according to Examples 1 and 2 was confirmed.

Examples 3 to 8 and Comparative Examples 3 to 8 (see FIGS. 2 and 3)

Besides Examples 1 and 2 and Comparative Examples 1 and 2, examples (Examples 3 to 8 and Comparative Examples 3 to 8) were examined. The examples inclusive of Examples 1 and 2 and Comparative Examples 1 and 2 were tabled as a list and shown in FIG. 2 (Examples) and FIG. 3 (Comparative Examples). Incidentally, the shape and material of each of the nozzles according to Examples 3 to 8 and Comparative Examples 3 to 8 were made equal to those of Example 2 except the diameter (D) of the nozzle inner hole portion.

In FIGS. 2 and 3, "L/H" and "πD/L" are shown. If the value of "L/H" is a "value larger than 2 (2<)", the "expression (2): L>2×H" is satisfied. If the value of "πD/L" is a "value not smaller than 3 (3≦)", the "expression (3): L≦πD/3" is satisfied. In FIGS. 2 and 3, the shape of each protrusion is shown as "approximate shape". (Because it is difficult to draw a "spherical" shape and an "elliptic" shape distinctively, the two shapes are shown as the same shape except the spherical protrusions in Comparative Example 3).

In FIGS. 2 and 3, "surface area increasing rate (%)" means the increasing rate of the "surface area of the nozzle inner hole portion after arrangement of the protrusions" to the "surface area of the nozzle inner hole portion before arrangement of the protrusions". Specifically, it means the surface area increasing rate in a region ranging from the start point of the protrusions in the uppermost portion (fitting portion side) to the end point of the protrusions in the lowermost portion (bottom portion).

The "degree of drifting" is evaluated in such a manner that a flow of discharged water is observed in the condition that 10 L/min of air is blown from the upper nozzle (tundish upper nozzle) in the water model experiment to make it easy to check the flow of discharged water. For example, in the case of Comparative Example 2, the "degree of drifting" is "large". This shows a state in which the meniscus (near the water level) near the right short side of the mold is swollen by an inverted current (upwelling current) generated because the left discharge flow is discharged downward at an angle of about 45° and creeps deeply to the lower end of the mold whereas the right discharge flow is discharged downward at an angle of about 10° and collides with the short side of the mold vigorously. That is, the state in which the left and right discharge flows are not uniform is referred to as "drifting". The "drifting" in accordance with the difference between the left and right discharge flows is simply shown in the list.

In FIGS. 2 and 3, "strength of protrusion" is evaluated in such a manner that a state of each protrusion is checked after the immersion nozzle used in the actual machine is collected and cut. "OK" expresses the fact that there is no damage (dropout) of each protrusion based on the collision with the molten steel flow. "NG" expresses the fact that damage of at least part of the protrusion is found. "Deposition of Alumina on Inner Pipe" is a result of measurement of the maximum thickness of alumina deposited after the nozzle used in the actual machine is collected. Generally, when the thickness of alumina is smaller than about 3 mm, there is no operating problem. If the thickness of alumina is larger than 5 mm, there arises a problem that throughput (the amount of molten steel passing through the pipe per predetermined time) cannot be kept or cast piece quality deteriorates because single-flow occurs in accordance with the state of deposition.

In FIGS. 2 and 3, "total evaluation" is made as follows. The case where there is no problem at all in "drifting" and "minus flow" in the water model experiment and in "strength of protrusion" in use of the actual machine is evaluated as "◎" if the "amount of alumina deposited on the inner pipe" is not larger than 1 mm, and as "○" if the "amount of alumina deposited on the inner pipe" is about 3 mm. The nozzle evaluated as "◎" or "○" exhibits an excellent effect compared with the conventional nozzle. The nozzle evaluated as "X" has a problem in any one of "drifting" and "minus flow" in the water model experiment and "strength of protrusion" in use of the actual machine. For this reason, the nozzle evaluated as "X" results in the "amount of alumina deposited on the inner pipe" being not smaller than 5 mm. Particularly in Comparative Examples 3 and 4, though there is no problem in evaluation in the water model experiment, the protrusions drop out in use of the actual machine to cause a state as if the protrusion were not disposed. As a result, a large amount of alumina is deposited. [Incidentally, as an annotation, only the convex portion of a step disposed on the straight inner pipe is drawn in the approximate shape of Comparative Example 1. In this case, the "maximum length (L) of the base portion" means the length of the outer circumference of this drawing, that is, the length is equal to the "length of the inner circumference of the inner pipe" which is originally straight].

Figure 8:
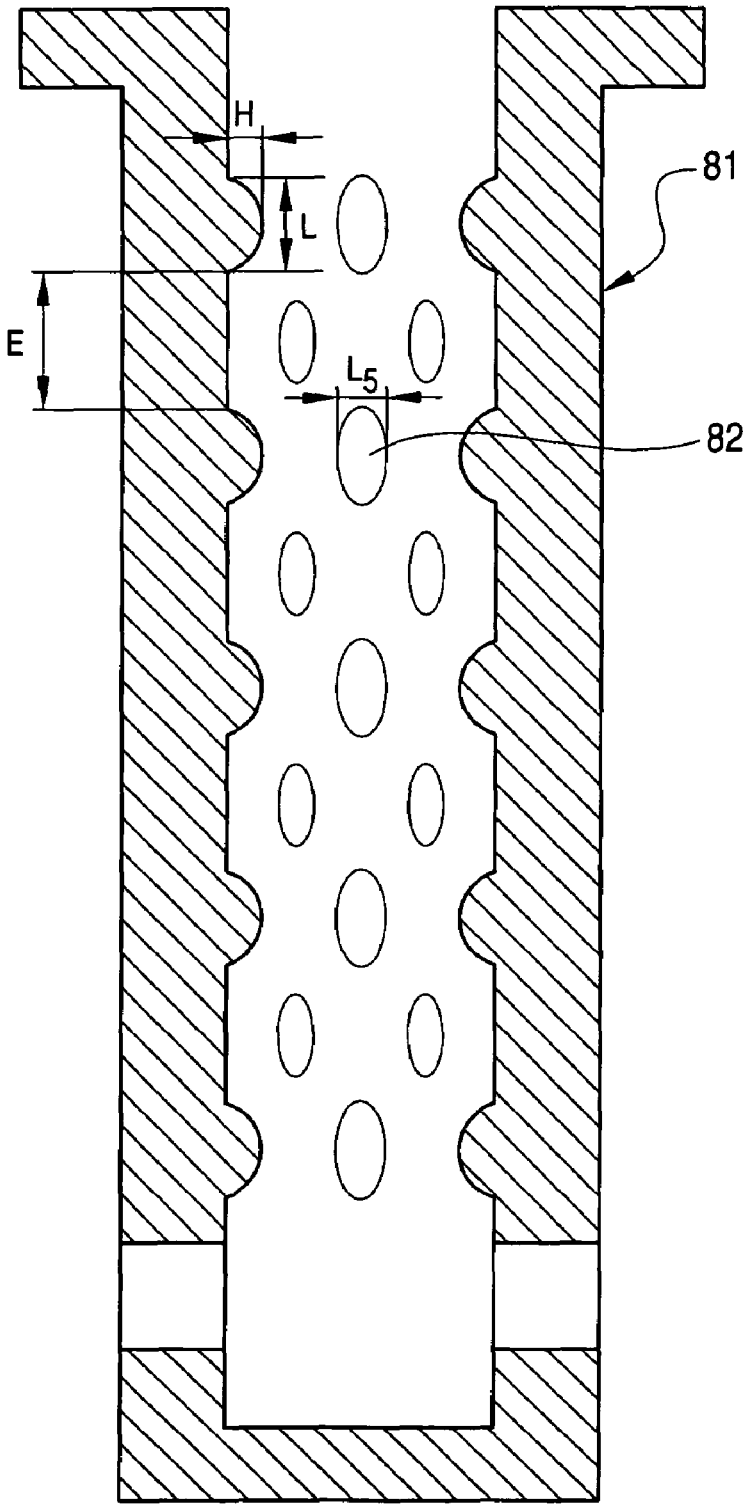
FIG. 8 is a view cut vertically in a direction parallel to the direction of a molten steel flow hole portion and showing an example (Example 9) in which protrusion portions are disposed in the molten steel flow hole portion.
Figure 9A:
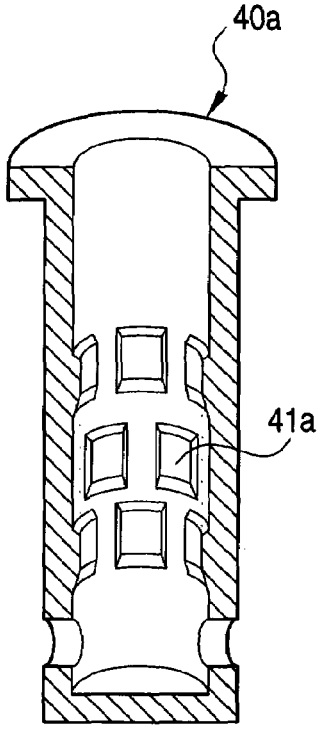
FIG. 9 is a view for explaining immersion nozzles according to Example 10 and Comparative Examples 11 and 12.
Figure 9B:
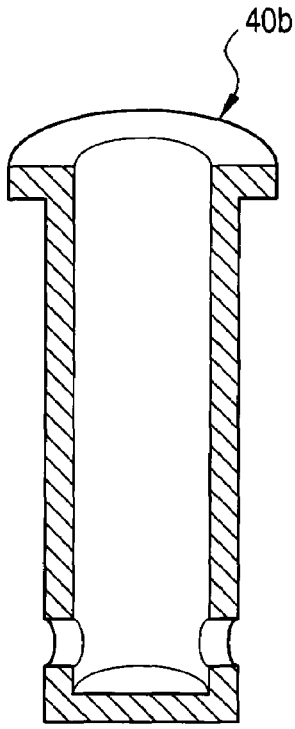
Figure 9C:
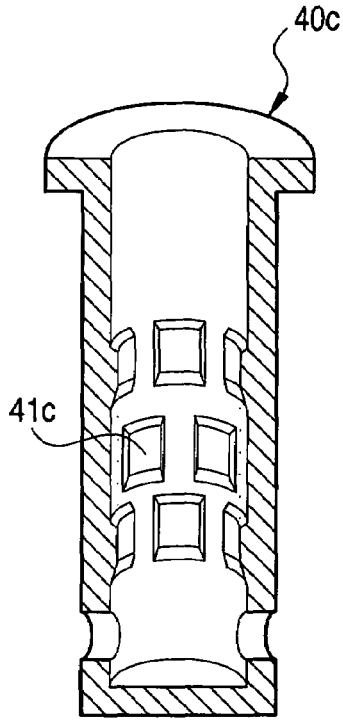
Figure 9D:
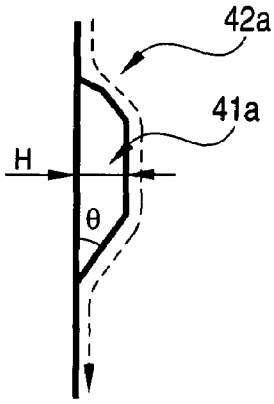
Figure 9E:
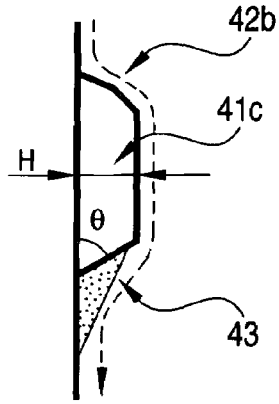
Figure 10A:
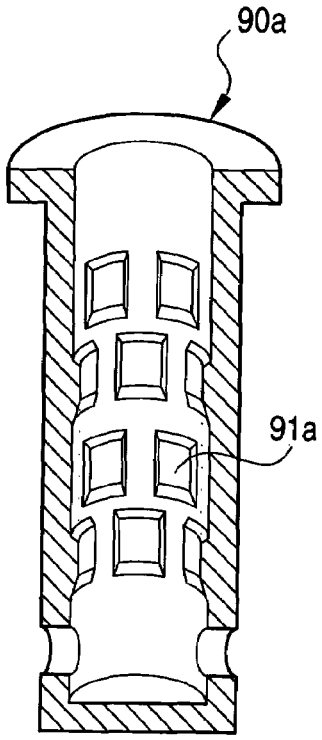
FIG. 10 is a view showing examples in which protrusion portions are disposed in a molten steel flow hole portion.
Figure 10B:
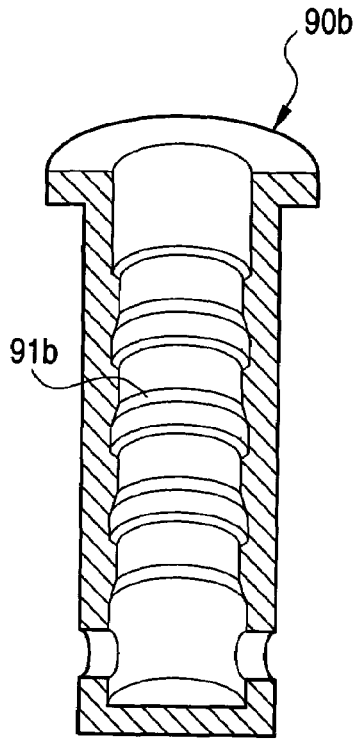
Figure 10C:
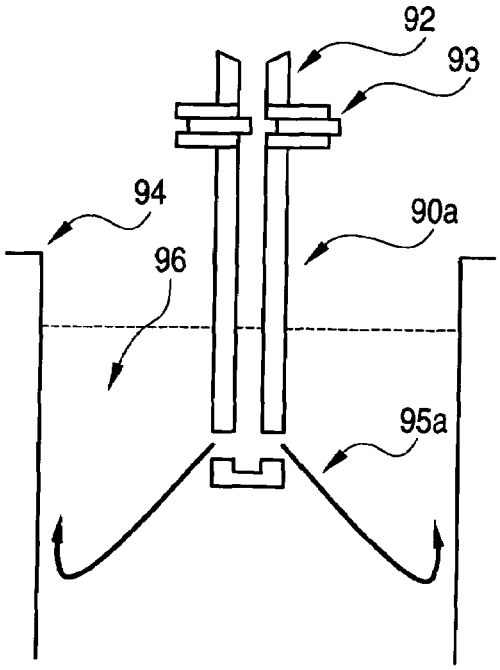
Figure 10D:
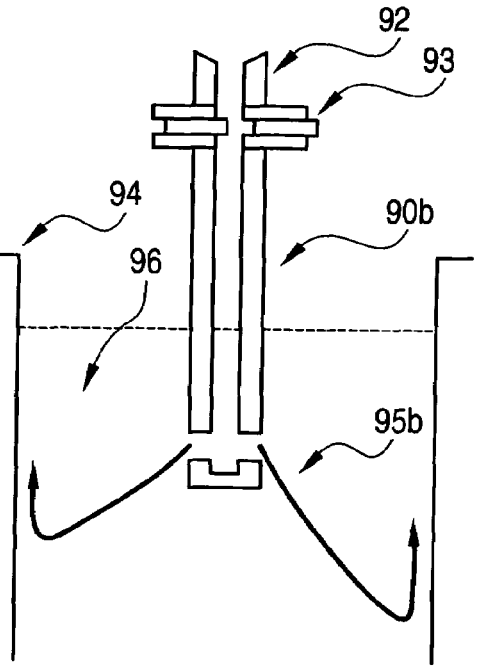

Example 9 and Comparative Examples 9 and 10 (see FIG. 8): Experimental Example Using Acrylic Immersion Nozzle Example 9 and Comparative Examples 9 and 10 to be compared with Example 9 will be described with reference to FIG. 8. Incidentally, FIG. 8 is a view vertically cut in a direction parallel to the molten steel flowing direction.

Elliptic protrusion portions 82 each having a height H=10 mm and a maximum base portion length $L_5$=30 mm in a direction (horizontal direction) perpendicular to the molten steel flowing direction were disposed in an acrylic immersion nozzle 81 with an inner diameter ϕ of 80 mm. A water model experiment was performed.

In Example 9, the distance E between protrusion portions and base portions of the protrusion portions in a direction (vertical direction) parallel to the molten steel flowing direction was set at 20 mm. On the other hand, in Comparative Example 9, a straight nozzle having no protrusion portion 82 disposed was used. In Comparative Example 10, a nozzle having protrusion portions (elliptic protrusion portions 82 of H=10 mm and L=30 mm like Example 9) disposed at intervals of the distance E=10 mm (out of the range specified b the invention) was used.

A flow of water in the inner hole portion was checked by eye observation in the condition of throughput equivalent to 5 steel·T/min. As a result, in Example 9, water flowed just under the protrusion portions and it was confirmed that there was no stagnation portion. In Comparative Example 10, water did not flow just under the protrusion portions and there were stagnation portions.

Then, maximum throughputs of Example 9 and Comparative Examples 9 and 10 were measured. A slide valve attached to the upper portion of the immersion nozzle was opened fully and a flow rate adjusting valve near a pump for circulating water was adjusted so that the water level in the mold was stabilized to a predetermined height (250 mm upward from the upper end of the discharge hole). The flow rate in this case was measured with a float type flowmeter. As a result, in the straight nozzle according to Comparative Example 9, water flowed up to the maximum throughput: 1200 L/min. On the other hand, in Comparative Example 10, water flowed up to only 850 L/min. On the contrary, in Example 9, water flowed up to 1150 L/min and the influence of the provision of the protrusion portions was slightly observed but the influence was suppressed to such a degree that there was no influence on the operation of the actual machine. This is conceived that water flows just under the protrusion portions in Example 9 to make it possible to keep throughput because the necessary distance of H=20 mm is kept, whereas water does not flow just under the protrusion portions in Comparative Example 10 to cause the same state as if the diameter of the inner hole per se were totally reduced because of only H=10 mm. Incidentally, it is conceived that if fluid does not flow just under each protrusion portion as shown in Comparative Example 10, the portion just under the protrusion portion serves as a stagnation portion on which alumina will be deposited in the actual machine.

Example 10 and Comparative Examples 11 and 12 (see FIG. 9): Experimental Example Using Acrylic Immersion Nozzle Example 10 and Comparative Examples 11 and 12 will be described with reference to (A) to (E) of FIG. 9. Incidentally, (A) of FIG. 9 is a view showing an immersion nozzle according to Example 10, and (B) and (C) of FIG. 9 are views showing immersion nozzles according to Comparative Examples 11 and 12 respectively. Each of these is a view vertically cut in a direction parallel to the molten steel flowing direction. Further, (D) of FIG. 9 is a view showing a section of a protrusion portion taken in a direction parallel to the molten steel flowing direction in the immersion nozzle (Example 10) depicted in (A) of FIG. 9, and (E) of FIG. 9 is a view showing a section of a protrusion portion taken in a direction parallel to the molten steel flowing direction in the immersion nozzle (Comparative Example 12) depicted in (C) of FIG. 9. These are views cm for explaining results of the "water model experiment" of the immersion nozzles according to Example 10 and Comparative Example 12.

Example 10 will be described with reference to (A) and (D) of FIG. 9. Example 10 is an example in which protrusion portions 41*a* each having a height of H=10 mm and a protrusion lower end angle of θ=45° are disposed in a transparent acrylic immersion nozzle 40*a* having an inner diameter ϕ of 80 mm. As shown in (B) of FIG. 9, Comparative Example 11 uses an immersion nozzle (straight nozzle) 40*b* having no protrusion portion disposed. As shown in (C) of FIG. 9, Comparative Example 12 uses an immersion nozzle 40*c* in which protrusion portions 41*c* each having a height of H=10 mm and a protrusion lower end angle of θ=70° are disposed. Incidentally, the protrusion portions 41*a* in Example 10 or the protrusion portions 41*c* in Comparative Example 12 were not annularly continuous so that four protrusion portions 41*a* or 41*c* were disposed on a plane perpendicular to the molten steel flowing direction and three stages of protrusion portions 41*a* or 41*c* were disposed in a direction parallel to the molten steel flowing direction, that is, twelve protrusion portions 41*a* or 41*c* in total were disposed.

(Water Model Experiment)

Each of the immersion nozzles according to Example 10 and Comparative Examples 11 and 12 was subjected to a "water model experiment". First, a flow of water in the inner hole portion was checked by eye observation in the condition of throughput equivalent to 5 steel·T/min. As a result, in the immersion nozzle 40*a* according to Example 10, water flowed even just under each protrusion 41*a*, so that it was confirmed that there was no stagnation portion [see "water flow 42*a*" in (D) of FIG. 9]. On the contrary, in the immersion nozzle 40*c* according to Comparative Example 12, water did not flow smoothly just under each protrusion portion 41*c*, so that there were stagnation portions 43 [see "water flow 42*b*" in (E) of FIG. 9].

Then, maximum throughputs of the immersion nozzles according to Example 10 and Comparative Examples 11 and 12 were measured. A slide valve attached to the upper portion of the immersion nozzle was opened fully and a flow rate adjusting valve near a pump for circulating water was adjusted so that the water level in the mold was stabilized to a predetermined height (250 mm upward from the upper end of the discharge hole). The flow rate in this case was measured with a float type flowmeter. As a result of measurement, in the immersion nozzle (straight nozzle) 40*b* according to Comparative Example 11, water flowed up to the maximum throughput: 1200 L/min. On the other hand, in the immersion nozzle 40*c* according to Comparative Example 12, water flowed up to only 1080 L/min. On the contrary, in the immersion nozzle 40*a* according to Example 10, water flowed up to 1170 L/min and the influence of the provision of the protrusion portions 41*a* was slightly observed but the influence could be suppressed to such a degree that there was no influence on the operation of the actual machine. This is conceived that water flows just under the protrusion portions 41*a* in Example 10 to make it possible to keep throughput because the necessary protrusion lower end angle of 45° is kept, whereas water does not flow just under the protrusion portions 41*c* in Comparative Example 12 to cause the same state as if the diameter of the inner hole per se were totally reduced because of the large protrusion lower end angle θ of 70°. It is experimentally proved that if fluid does not smoothly flow just under each protrusion portion as shown in Comparative Example 12, the portion just under the protrusion portion serves as a stagnation portion on which alumina will be deposited in the actual machine.

Example 11 and Comparative Example 13 (see FIG. 10): Experimental Example Using Acrylic Immersion Nozzle Example 11 and Comparative Example 13 will be described with reference to (A) to (D) of FIG. 10. Incidentally, (A) of FIG. 10 is a view showing an immersion nozzle according to Example 11, and (B) of FIG. 10 is a view showing an immersion nozzle according to Comparative Example 13. Each of these is a view vertically cut in a direction parallel to the molten steel flowing direction. Further, (C) of FIG. 10 is a schematic view for explaining a discharge flow in the immersion nozzle (Example 11) depicted in (A) of FIG. 10, and (D) of FIG. 10 is a schematic view for explaining a discharge flow in the immersion nozzle (Comparative Example 13) depicted in (B) of FIG. 10.

As shown in (A) of FIG. 10, Example 11 is an example in which protrusion portions 91*a* each having a height of 13 mm and a protrusion lower end angle of 35° are disposed in a transparent acrylic immersion nozzle 90*a* having an inner diameter ϕ of 70 mm. As the protrusion portions 91*a*, four stages of protrusion portions, that is, sixteen protrusion portions in total are disposed so that four protrusion portions are disposed on a plane perpendicular to the molten steel flowing direction. On the other hand, as shown in (B) of FIG. 10, Comparative Example 13 uses an immersion nozzle 90*b* in which protrusion portions 91*b* each having the same vertical sectional shape as that in Example 11 but annularly continuous on a plane perpendicular to the molten steel flowing direction are disposed as four stages of protrusion portions.

(Water Model Experiment)

Each of the immersion nozzles according to Example 11 and Comparative Example 13 was subjected to a "water model experiment". The water model experiment was performed in the condition that throughput was set to be equivalent to 4 steel·T/min in such a manner that three slide plates 93 were used and middle one of the three slide plates 93 was slid in parallel to a long side of a mold 94 to control the flow rate as shown in (C) and (D) of FIG. 10. Further, 5 L/min of air was blown from the upper nozzle 92 disposed just on the slide plates 93 so that a flow of water 96 in the mold 94 could be observed easily.

A result of Example 11 is shown in (C) of FIG. 10, and a result of Comparative Example 13 is shown in (D) of FIG. 10. Flows of water discharged from the discharge holes and flowing in the molds 94, that is, discharge flows 95*a* and 95*b* are illustrated in brief. In the immersion nozzle 90*a* according to Example 11 in which the protrusion portions were independent of each other, the flow of water [discharge flow 95*a*] in the mold 94 was substantially uniform and stable bisymmetrically. On the contrary, in the immersion nozzle 90*b* according to Comparative Example 13 in which each of the protrusion portions was shaped like a ring, the right discharge flow 96*b* crept more deeply than the left discharge flow, that is, it was apparent that drifting could not be eliminated. Accordingly, it is proved that independent protrusions are preferred to ring-like protrusions each being annularly continuous on one plane perpendicular to the molten steel flowing direction.

Examples 12 to 16 and Comparative Examples 14 to 18 (see FIG. 11): Experimental Example Using Acrylic Immersion Nozzle FIG. 11 shows "sectional shapes of protrusion portions (sectional shapes cut in parallel to the molten steel flowing direction)" disposed in immersion nozzles according to Examples 12 to 16 and Comparative Examples 14 to 18. Among these, each of the protrusion portions in Examples 14 and 15 is shown as an example in which the height (height h toward the center of the nozzle inner pipe) of the lower end portion of each protrusion portion was set at 1 mm. Incidentally, each of the immersion nozzles according to Examples 12 to 16 and Comparative Examples 14 to 18 is a transparent acrylic immersion nozzle having an inner diameter+of 80 mm and having protrusion portions with a maximum height of 8 mm.

(Water Model Experiment)

Each of the immersion nozzles according to Examples 12 to 16 and Comparative Examples 14 to 18 was subjected to a "water model experiment". FIG. 11 shows results of the experiment. As was apparent from FIG. 11, in each of the immersion nozzles according to Examples 12, 13 and 16 in which the "protrusion lower end angle θ" was "not larger than 60°", stagnation was not observed just under each protrusion portion and a good straightening effect was obtained. Even in each of Examples 14 and 15 in which the height (height h toward the center of the nozzle inner pipe) of the lower end portion of each protrusion portion was set at "1 mm", it was found that stagnation was not observed just under each protrusion portion and a good straightening effect was obtained if the height was smaller than 2 mm and the "protrusion lower end angle θ" was "not larger than 60°".

On the contrary, in each of the immersion nozzles according to Comparative Examples 14 to 18 in which the "protrusion lower end angle θ" was "not smaller than 60°", stagnation was observed just under each protrusion portion and there was no good straightening effect obtained.

INDUSTRIAL APPLICABILITY

Use of the casting nozzle according to the invention permits (1) elimination of drifting in the molten steel flow hole portion of the nozzle, (2) uniformization of the flow rate distribution in the discharge hole portion (to prevent generation of minus flow) to prevent melting loss in the discharge hole portion due to suction of mold powder, (3) elimination of drifting in the left and right of the mold and (4) prevention of deposition of alumina on a space between protrusions to continue the effect of the protrusions disposed in the molten steel flow hole portion of the nozzle. As a result, continuous casting of steel can be performed easily. In addition, high-quality steel can be cast easily because mold powder is not involved.

The invention claimed is:

1. A casting nozzle having a molten steel flow hole portion, in which a plurality of independent members comprising at least one of protrusion portions and concave portions discontinuous in both directions parallel and perpendicular to a molten steel flowing direction are disposed, wherein each of said protrusion portions or the concave portions has a size satisfying expressions:

$$H>2\text{ mm}$$

$$L>2\times H$$

in which H is a maximum height of the protrusion portion or a maximum depth of the concave portion, and L is a maximum length of a base portion of the protrusion portion or the concave portion, to prevent a flow of the molten steel from stagnating in the molten steel flow hole portion, wherein the independent members make an inner surface area of the molten steel flow hole portion rough so that an inner diameter of the molten steel flow hole portion becomes variable over the inner surface of the rough area, the casting nozzle is an immersion nozzle, and the base portions of the independent members are spaced apart from one another by portions of a flat surface of the inner surface area of the molten steel flow hole portion.

2. The casting nozzle according to claim 1, wherein each of said protrusion portions or the concave portions satisfies an expression:

$$L\leqq\pi D/3$$

in which L is the maximum length of a base portion of the protrusion portion or the concave portion, and D is an inner diameter of the nozzle before the protrusion portions or concave portions are disposed.

3. The casting nozzle according to claim 1, wherein said protrusion portions or the concave portions are disposed so that an inner surface area of a molten steel flow path in a range in which said protrusion portions or the concave portions are disposed is 102-350% as large as an inner surface area of the molten steel path before disposition of said protrusion portions or the concave portions.

4. The casting nozzle according to claim 1, wherein said casting nozzle has a portion where said protrusion portions or the concave portions are disposed in a zigzag pattern so that positions of corresponding protrusion portions or concave portions are displaced at least in the direction perpendicular to the molten steel flowing direction.

5. The casting nozzle according to claim 1, wherein said protrusion portions or the concave portions are disposed over an entire or a part of the molten steel flow hole portion of the casting nozzle.

6. The casting nozzle according to claim 1, wherein said protrusion portions or the concave portions are disposed to be not higher than a meniscus of the casting nozzle.

7. The casting nozzle according to claim 1, wherein a distance between the base portions of said protrusion portions in the direction parallel to the molten steel flowing direction is selected to be equal to or greater than 20 mm to prevent generation of a stagnation portion on an area of the inner hole portion disposed under the protrusion portion.

8. The casting nozzle according to claim 1, wherein the height of each of said protrusion portions is 2-20 mm.

9. The casting nozzle according to claim 1, wherein a number of said protrusion portions disposed in the molten steel flowing hole portion is equal to or greater than 4.

10. The casting nozzle according to claim 1, wherein an angle between a nozzle inner pipe and a lower end portion of each of said protrusion portions in the direction parallel to the molten steel flowing direction is selected to be equal to or less than 60° to prevent generation of a stagnation portion on an area of the inner hole portion disposed under the protrusion portion.

11. The casting nozzle according to claim 1, wherein said protrusion portions are molded to be integrated with a body of the casting nozzle.

12. The casting nozzle according to claim 1, wherein said casting nozzle is the immersion nozzle for continuously casting steel.

13. The casting nozzle according to claim 1, wherein the inner rough area of the molten steel flow hole portion is generally one of circular and elliptical.

14. The casting nozzle according to claim 13, wherein a cross-section of the inner rough area in the direction perpendicular to the molten steel flowing direction comprises discontinuous circumferential segments.

15. The casting nozzle according to claim 1, wherein the independent members include at least one of elliptical, spherical, semi-spherical, and approximate polygonal pyramid independent members.

16. The casting nozzle according to claim 15, wherein the independent members include at least one of the elliptical and spherical independent members.

17. The casting nozzle according to claim 15, wherein the independent members include at least one of semi-spherical protrusion portions and approximate polygonal pyramid protrusion portions, and wherein an angle between a nozzle inner pipe and a lower end portion of each protrusion portion in the direction parallel to the molten steel flowing direction is selected to be equal to or less than 60° to prevent generation of a stagnation portion on an area of the inner hole portion disposed under the protrusion portion.

18. The casting nozzle according to claim 1, wherein the independent members include the protrusion portions, each having the height equal to or greater than 2mm and the length of the base portion in the direction parallel to the molten steel flowing direction is greater than a double of the height to prevent generation of a stagnation portion on an area of the inner hole portion disposed under the protrusion portion.

19. The casting nozzle according to claim 1, wherein the immersion nozzle includes a straight immersion nozzle having the inner diameter before the protrusion portions or concave portions are disposed of a substantially invariable value in the direction parallel to the molten steel flowing direction.

20. The casting nozzle according to claim 1, wherein the immersion nozzle includes a stationary immersion nozzle.

* * * * *